US006135839A

United States Patent [19]

Iwase et al.

[11] Patent Number: 6,135,839

[45] Date of Patent: Oct. 24, 2000

[54] METHOD OF FABRICATING EDGE TYPE FIELD EMISSION ELEMENT

[75] Inventors: Yuichi Iwase, Kanagawa; Masami Okita, Tokyo, both of Japan

[73] Assignee: Sony Corporation, Tokyo, Japan

[21] Appl. No.: 09/430,126

[22] Filed: Oct. 29, 1999

Related U.S. Application Data

[62] Division of application No. 09/056,937, Apr. 8, 1998.

[30] Foreign Application Priority Data

Apr. 11, 1997 [JP] Japan ..... P9-093669

[51] Int. Cl.[7] ..... H01J 9/02

[52] U.S. Cl. ..... 445/24

[58] Field of Search ..... 445/24, 25, 50

[56] References Cited

U.S. PATENT DOCUMENTS

| | | | |
|---|---|---|---|
| 5,079,476 | 1/1992 | Kane | 313/308 |
| 5,136,764 | 8/1992 | Vasquez | 29/25 |
| 5,214,347 | 5/1993 | Gray | 313/355 |
| 5,266,155 | 11/1993 | Gray | 156/651 |
| 5,430,347 | 7/1995 | Kane et al. | 313/336 |
| 5,463,269 | 10/1995 | Zimmerman | 313/309 |
| 5,562,516 | 10/1996 | Spindt et al. | 445/24 |

FOREIGN PATENT DOCUMENTS

| | | |
|---|---|---|
| 0501785A2 | 9/1992 | European Pat. Off. . |
| 5-225914 | 9/1993 | Japan . |
| 7-130283 | 5/1995 | Japan . |

*Primary Examiner*—Kenneth J. Ramsey

*Attorney, Agent, or Firm*—Ronald P. Kananen; Rader, Fishman & Grauer

[57] ABSTRACT

A field emission display having element including a first electrode, and a second electrode laminated to the first electrode through an insulating layer. The first electrode has an opening; the second electrode has a hole of a planar shape corresponding to that of the opening at a position matched with the opening; and the insulating layer has a through-hole continuous to the opening and the hole. An upper edge portion of the hole is formed into a cross-sectional shape having an edge angle in a range of 80 to 100°, and at least part of the upper edge portion of the hole is exposed in the through-hole. In this element, electrons are emitted from the second electrode through the upper edge portion of the hole exposed in the through-hole by applying a specific voltage between the first electrode and the second electrode. With this configuration, a distance between the gate electrode and a field emission portion of the cathode electrode can be accurately controlled with a simple structure. To enhance an emission efficiency of electrons, a second gate electrode may be provided on the lower side of the cathode electrode through an insulating layer.

10 Claims, 22 Drawing Sheets

METHOD OF FABRICATING EDGE TYPE FIELD EMISSION ELEMENT

RELATED APPLICATION

This application is a divisional of copending application Ser. No. 09/056,937, filed Apr. 8, 1998.

BACKGROUND OF THE INVENTION

The present invention relates to a field emission element for allowing electrons to be emitted from a surface of a metal or a semiconductor by utilizing a field emission phenomenon, a method of fabricating the element, and a field emission display using the field emission element.

A field emission element, which allows electrons to be emitted from a solid due to no thermal excitation, is typically used for an electron source for drive of a FED (Field Emission Display).

As such a field emission element, there has been known a Spindt type in which a cold cathode for emitting electrons is formed into a pyramid or cone shape.

A method of fabricating the related art Spindt type field emission element will be described with reference to FIGS. 27A to 27C and FIGS. 28A and 28B.

As shown in FIG. 27A, a cathode electrode 101 made from chromium (Cr), niobium (Nb), tantalum (Ta), tungsten (W) or the like is formed into a specific pattern on a glass substrate 100. A gate electrode 103 made from Cr, Nb, Ta, W or the like is formed into a pattern crossing the pattern of the cathode electrode 101 on the cathode electrode 101 through a silicon oxide ($SiO_2$) film 102. A resist film 104 is formed on the gate electrode 103, and an opening 105 is formed in the resist film 104 at a specific position by photolithography. Then, the gate electrode 103 is etched using the resist film 104 as an etching mask, to form an opening 106 having a diameter of about 1 $\mu$m in the gate electrode 103.

As shown in FIG. 27B, the $SiO_2$ film 102 is etched through the opening 106 of the gate electrode 103, to form a through-hole 107 in the $SiO_2$ film 102. At this time, the $SiO_2$ film 102 is side-etched, so that as shown in FIG. 27B, the through-hole 107 is slightly wider than the opening 106 of the gate electrode 103.

As shown in FIG. 27C, the resist film 104 is removed and a peeling layer 108 made from aluminum (Al) or the like is formed on the gate electrode 103 by oblique vapor-deposition.

As shown in FIG. 28A, a metal material such as molybdenum (Mo) or W or a semiconductor material such as diamond is vapor-deposited in the direction substantially perpendicular to the substrate 100, to form a vapor-deposition layer 109 on the gate electrode 103, and also to form, through the opening 106 of the gate electrode 103, a cathode cone (or emitter cone) 110 made from the above material on a portion of the cathode electrode 101 exposed in the through-hole 107 of the $SiO_2$ film 102.

Then, as shown in FIG. 28B, the peeling layer 108 is removed by dissolution, to peel the vapor-deposition layer 109 on the gate electrode 103.

With these steps, a Spindt type field emission element is formed in which the cathode cone 110 as a field emission source is provided in the fine opening 106 formed in the gate electrode 103.

The field emission element thus formed is used as an electron source for drive of a display such as a FED.

For example, as shown in FIG. 29, when a specific voltage Vg is applied between the gate electrode 103 and the cathode electrode 101 of one selected from the field emission elements arranged in a matrix pattern corresponding to a matrix pattern of pixels, there occurs concentration of an electric field at a peak portion of the cathode cone 110. This allows electrons to be emitted from the peak portion of the cathode cone 110. The electrons thus emitted are accelerated by a voltage Va applied between the gate electrode 103 and a transparent electrode 111 as an anode, and then collide with a phosphor screen 112, thereby allowing light emission of the phosphor screen 112.

In the above-described related art Spindt type field emission element, field emission characteristics thereof are largely affected by a distance between the opening 106 of the gate electrode 103 and the peak portion of the cathode cone 110. On the other hand, such a distance is dependent on in-plane uniformity of thickness of the vapor-deposition film 109, and more specifically, the distance varies depending on the amplified non-uniformity of the film thickness. Accordingly, for example, in order to fabricate a display having uniform field emission characteristics, the above step of forming the vapor-deposition layer 109 is required to be carried out such that the vapor-deposition film 109 is uniformly formed at a high accuracy over the entire surface of the substrate.

However, it has been very difficult to form the vapor-deposition film 109 uniformly at a high accuracy over the entire surface of a large-area substrate, and therefore, it has failed to realize a large-area display with a high quality.

Another problem of the related art Spindt type field emission element is that the fabricating yield has been poor because of contamination of the element occurring upon peeling of the vapor-deposition layer 109.

SUMMARY OF THE INVENTION

An object of the present invention is to provide a field emission element having a structure capable of relatively easily, uniformly controlling a distance between a gate electrode and an electron emitting portion of a cathode electrode, a method of manufacturing the element, and a display using the element.

Another object of the present invention is to provide a field emission element having a structure without requiring a step of peeling a vapor-deposition layer, a method of fabricating the element, and a display using the element.

To achieve the above objects, according to a first aspect of the present invention, there is provided a field emission display having a field emission element, the field emission element including: a first electrode, and a second electrode laminated to the first electrode through an insulating layer, the first electrode having an opening, the second electrode having a hole of a planar shape corresponding to that of the opening at a position matched with the opening, the insulating layer having a through-hole continuous to the opening and the hole; wherein an upper edge portion of the hole is formed into a cross-sectional shape having an edge angle in a range of 80 to 100°; and at least part of the upper edge portion of the hole is exposed in the through-hole; whereby electrons are emitted from the second electrode through the upper edge portion of the hole exposed in the through-hole by applying a specific voltage between the first electrode and the second electrode.

According to a second aspect of the present invention, there is provided a method of fabricating a field emission display, including the steps of: forming a first electrode layer on an insulating substrate; forming an insulating layer on the first electrode layer; forming a second electrode layer on the insulating layer; forming an opening in the second electrode layer at a specific position; etching the insulating layer through the opening of the second electrode layer, to form in the insulating layer a through-hole continuous to the opening of the second electrode layer and wider than the opening; and anisotropic-etching the first electrode layer through the opening of the second electrode layer and the through-hole of the insulating layer, to form in the first electrode layer a hole continuous to the through-hole of the insulating layer and having a planer shape being substantially the same as that of the opening of the second electrode layer.

According to a third aspect of the present invention, there is provided a method of fabricating a field emission display, including the steps of: forming a first insulating layer on a conductive substrate or semiconductor substrate; forming a first electrode layer on the first insulating layer; forming a second insulating layer on the first electrode layer; forming a second electrode layer on the second insulating layer; forming an opening in the second electrode layer at a specific position; etching the second insulating layer through the opening of the second electrode layer, to form in the second insulating layer a through-hole continuous to the opening of the second electrode layer and wider than the opening; and anisotropic-etching the first electrode layer through the opening of the second electrode layer and the through-hole of the second insulating layer, to form in the first electrode layer a hole continuous to the through-hole of the second insulating layer and having a planar shape being substantially the same as that of the opening of the second electrode layer.

According to a fourth aspect of the present invention, there is provided a field emission display having a field emission element, the field emission element including: a first electrode, a second electrode laminated to the first electrode through a first insulating layer, and a third electrode laminated to the second electrode through a second insulating layer, the first electrode having an opening, the second electrode having a hole of a planar shape corresponding to that of the opening at a position matched with the opening, the first insulating layer having a through-hole continuous to the opening and the hole; wherein at least part of an upper edge portion of the hole is exposed in the through-hole; whereby electrons are emitted from the second electrode through the upper edge portion of the hole exposed in the through-hole by applying a first voltage between the first electrode and the second electrode and a second voltage equal to or less than the first voltage between the second electrode and the third electrode.

According to a fifth aspect of the present invention, there is provided a method of fabricating a field emission display, including the steps of: forming a first electrode layer on an insulating substrate; forming a first insulating layer on the first electrode layer; forming a second electrode layer on the first insulating layer; forming a second insulating layer on the second electrode layer; forming a third electrode layer on the second insulating layer; forming an opening in the third electrode layer at a specific position; etching the second insulating layer through the opening of the third electrode layer, to form in the second insulating layer a through-hole continuous to the opening of the third electrode layer and wider than the opening; and anisotropic-etching the second electrode layer through the opening of the third electrode layer and the through-hole of the second insulating layer, to form in the second electrode layer a hole continuous to the through-hole of the second insulating layer and having a planar shape being substantially the same as that of the opening of the third electrode layer.

According to a sixth aspect of the present invention, there is provided a field emission display having a field emission element, the field emission element including: a first electrode, and a second electrode laminated on the first electrode through an insulating layer, the first electrode having an opening, the second electrode having, at a position matched with the opening, a hole having a planar shape including the opening and being partially overlapped to the opening, the insulating hole having a through-hole continuous to the opening and the hole; wherein at least part of an upper edge portion of the hole is exposed in the through-hole; whereby electrons are emitted from the second electrode through the upper edge portion of the hole exposed in the through-hole by applying a specific voltage between the first electrode and the second electrode.

According to a seventh aspect of the present invention, there is provided a method of fabricating a field emission display, including the steps of: forming a first electrode layer on an insulating substrate; forming a first hole having a specific planar shape in the first electrode layer at a specific position; forming an insulating layer on the first electrode layer; forming a second electrode layer on the insulating layer; forming, in the second electrode layer at a specific position, an opening having a planar shape being partially overlapped to the first hole of the first electrode layer; etching the insulating layer through the opening of the second electrode layer, to form in the insulating layer a through-hole continuous to the opening of the second electrode layer and wider than the opening; and anisotropic-etching the first electrode layer through the opening of the second electrode layer and the through-hole of the insulating layer, to form in the first electrode layer a second hole continuous to the through-hole of the insulating layer and having a planar shape being substantially the same as that of the opening of the second electrode layer.

According to an eighth aspect of the present invention, there is provided a field emission display having a field emission element, including: a first electrode, a second electrode laminated to the first electrode through a first insulating layer, and a third electrode laminated on the second electrode through a second insulating layer, the first electrode having an opening, the second electrode having, at a position matched with the opening, a hole having a planar shape including the opening and being partially overlapped to the opening, the first insulating layer having a through-hole continuous to the opening and the hole; wherein at least part of an upper edge portion of the hole is exposed in the through-hole; whereby electrons are emitted from the second electrode through the upper edge portion of the hole exposed in the through-hole by applying a first voltage between the first electrode and the second electrode and a second voltage equal to or less than the first voltage between the second electrode and the third electrode.

According to a ninth aspect of the present invention, there is provided a method of fabricating a field emission display, including the steps of: forming a first electrode layer on an insulating substrate; forming a first insulating layer on the first electrode layer; forming a second electrode layer on the first insulating layer; forming, in the second electrode layer at a specific position, a first hole having a specific planar shape; forming a second insulating layer on the second electrode layer; forming a third electrode layer on the second insulating layer; forming, in the third electrode at a specific position, a hole having a planar shape being partially overlapped to the first hole of the second electrode layer; etching the second insulating layer through the opening of the third electrode layer, to form in the second insulating layer a through-hole continuous to the opening of the third electrode layer and wider than the opening; and anisotropic-etching the second electrode layer through the opening of the third electrode layer and the through-hole of the second electrode layer, to form in the second electrode layer a second hole continuous to the through-hole of the second insulating layer and having a planar shape being substantially the same as that of the opening of the third electrode layer.

In the field emission element of the present invention, as described above, a first electrode is laminated on a second electrode through an insulating layer, and a hole having a planar shape corresponding to that of an opening provided in the first electrode is provided in the second electrode, whereby electrons are emitted from an upper edge portion of the second electrode constituting the hole.

Accordingly, a distance between the opening portion of the first electrode and the field emission portion of the second electrode can be simply, uniformly controlled only by adjustment of a thickness of the insulating layer therebetween. As a result, the field emission element of the present invention can be suitably used as an electron source for drive of a display having a large-sized screen.

In the field emission element of the present invention, since the hole of the second electrode can be formed in self-alignment to the opening of the first electrode, the fabrication method of the field emission element can be significantly simplified. Also, since there is no need of peeling of a metal vapor-deposition film as in a related art Spindt type element, it is possible to eliminate the problem of contamination of the element due to peeling of the metal vapor-deposition film, and hence to improve the fabricating yield.

According to the field emission element of the present invention, the emission efficiency of electrons from the second electrode can be improved by using as a second gate electrode a third electrode provided on the second electrode opposite to the first electrode or using as a second gate electrode a conductive substrate or semiconductor substrate provided on the second electrode opposite to the first electrode. As a result, the field emission element of the present invention can be driven at a lower voltage.

BRIEF DESCRIPTION OF THE DRAWINGS

FIGS. 18A-1 to 18C-2 are sectional views and plan views showing sequential steps of fabricating the field emission element in the ninth embodiment of the present invention;

DETAILED DESCRIPTION OF THE PREFERRED EMBODIMENTS

Hereinafter, preferred embodiments of the present invention will be described with reference to the accompanying drawings.

Embodiment 1

Figure 1:
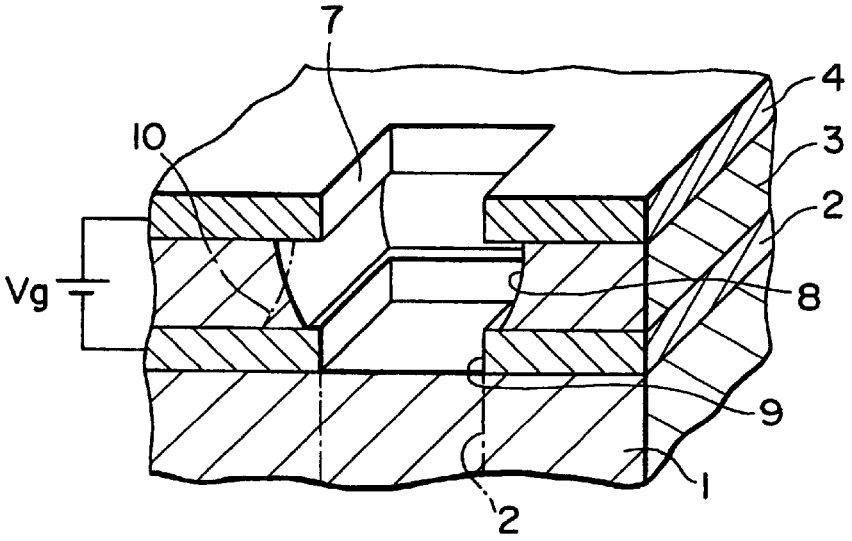
FIG. 1 is a sectional view showing a structure of a field emission element in accordance with a first embodiment of the present invention.
Figure 2:
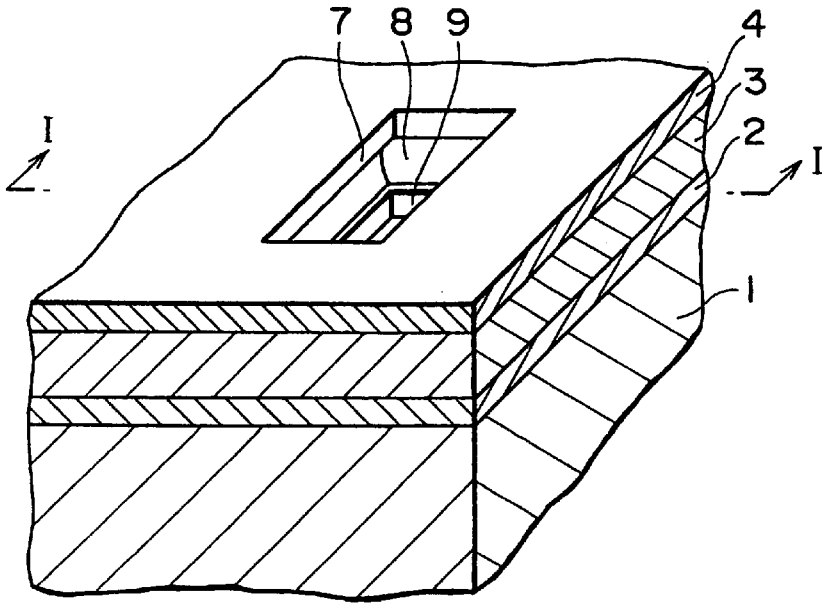
FIG. 2 is a perspective view showing an opening shape of a gate electrode of the field emission element in the first embodiment of the present invention.

FIG. 1 shows a sectional structure of a field emission element in accordance with a first embodiment of the present invention; and FIG. 2 shows an opening shape of a gate electrode of the field emission element shown in FIG. 1. In addition, FIG. 1 is the sectional view taken on line I—I of FIG. 2.

First, a method of fabricating the field emission element in accordance with the first embodiment will be described with reference to FIGS. 4A to 4D.

Figure 4A:
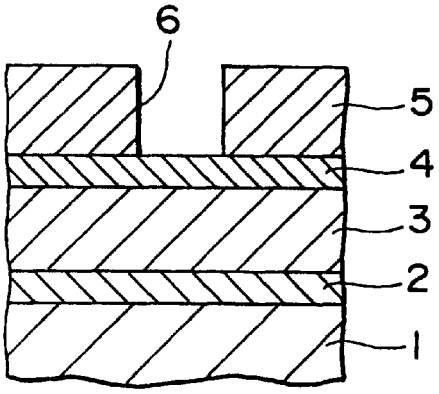
FIGS. 4A to 4D are sectional views showing sequential steps of fabricating the field emission element in the first embodiment of the present invention.

As shown in FIG. 4A, a cathode electrode 2 having a specific pattern, made from a metal material such as W, Nb, Ta, Mo or Cr or a semiconductor material such as diamond, is formed on an insulating substrate 1 represented by a glass substrate to a thickness of about 50 to 300 nm by CVD (Chemical Vapor Deposition) or sputtering. An insulating layer 3 made from silicon oxide, silicon nitride or the like is formed on the cathode electrode 2 to a thickness of about 200 nm to 1 $\mu$m by CVD. A gate electrode 4 made from a metal material such as W, Nb, Ta, Mo or Cr is formed on the insulating layer 3 to a thickness of about 50 to 300 nm by CVD or sputtering, and the gate electrode 4 is then processed into a specific pattern crossing the pattern of the cathode electrode 2.

A resist film 5 is formed on the gate electrode 4, and an opening 6 having a specific shape is formed in the resist film 5 by photolithography. The opening 6 has the same shape as that of an opening which will be formed later in the gate electrode 4. For example, the opening 6 is formed into a rectangular shape having a long side of about 1 to 200 $\mu$m or an elliptic shape having a major axis of about 1 to 200 $\mu$m. Of course, the opening 6 may be formed into a shape different from the rectangular or elliptic shape.

Figure 4C:
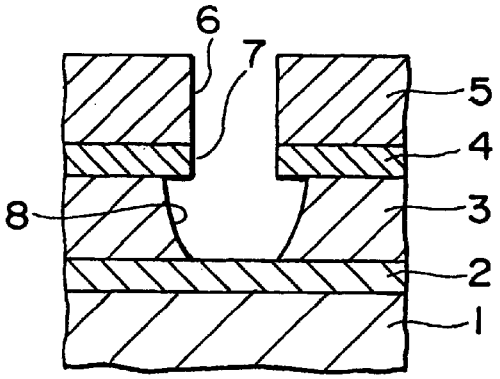
Figure 4B:
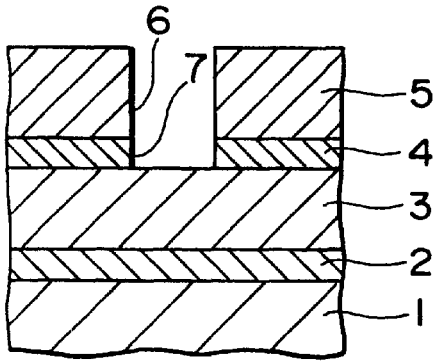

As shown in FIG. 4B, the gate electrode 4 is etched using the resist film 5 having the opening 6 as an etching mask by RIE (Reactive Ion Etching), to form in the gate electrode 4 an opening 7 having a shape corresponding to that of the opening 6 formed in the resist film 5.

As shown in FIG. 4C, the insulating layer 3 is etched through the opening 6 of the resist film 5 and the opening 7 of the gate electrode 4 by RIE or by use of hydrofluoric acid, to form in the insulating layer 3 a through-hole 8 reaching the cathode electrode 2. At this time, the insulating layer 3 is side-etched somewhat, so that as shown in FIG. 4C, the through-hole 8 is slightly wider than the opening 7 of the gate electrode 4.

Figure 4D:
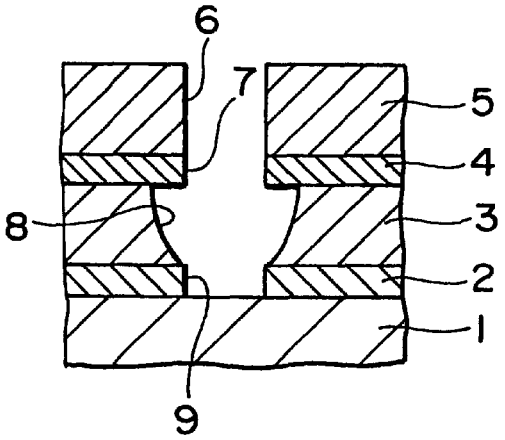

As shown in FIG. 4D, the cathode electrode 2 is etched by RIE, through the opening 6 of the resist film 5, the opening 7 of the gate electrode 4, and the through-hole 8 of the insulating layer 3, to form a hole 9 in the cathode electrode 2. At this time, since the etching (RIE in this embodiment) for the cathode electrode 2 is strong in anisotropy, the hole 9 is formed into a planar shape being substantially the same as that of the opening 7 of the gate electrode 4, and further, an edge of an upper edge portion of the cathode electrode 2 at the hole 9 portion is formed into an approximately upright shape.

At this time, since the through-hole 8 of the insulating layer 3 is slightly wider than the opening 7 of the gate electrode 4 as described above, the upper edge portion (as a field emission portion) of the cathode electrode 2 at the hole 9 portion is exposed in the through-hole 8 of the insulating layer 3. In addition, the insulating layer 3 may be then wet-etched using hydrofluoric acid so that the upper edge portion of the cathode electrode 2 at the hole 9 portion is certainly exposed. It is preferable that the upper edge portion of the cathode electrode 2 be exposed a distance of about 0.3 $\mu$m or more from the insulating layer 3.

As indicated by a chain line 10 of FIG. 1, the insulating layer 3 can be side-etched into an inverse-taper shape by adjusting a vacuum degree of a CVD system upon formation of the insulating layer 3 such that a degree of adhesion between the cathode electrode 2 and the insulating layer 3 is poor. The formation of such an inverse-taper shape of the insulating layer 3 allows the upper edge portion of the cathode electrode 2 at the hole 9 portion to be more certainly exposed in the through-hole 8 of the insulating layer 3.

In addition, not only the hole 9 passing through the cathode electrode 2 as shown in FIG. 4D but also a recessed hole not passing through the cathode electrode 2 may be formed in the cathode electrode 2. In this specification, a through-hole and a recessed hole are referred to generally as "holes".

The resist film 5 is then removed by ashing or the like, to obtain a structure shown in FIGS. 1 and 2.

Figure 29:
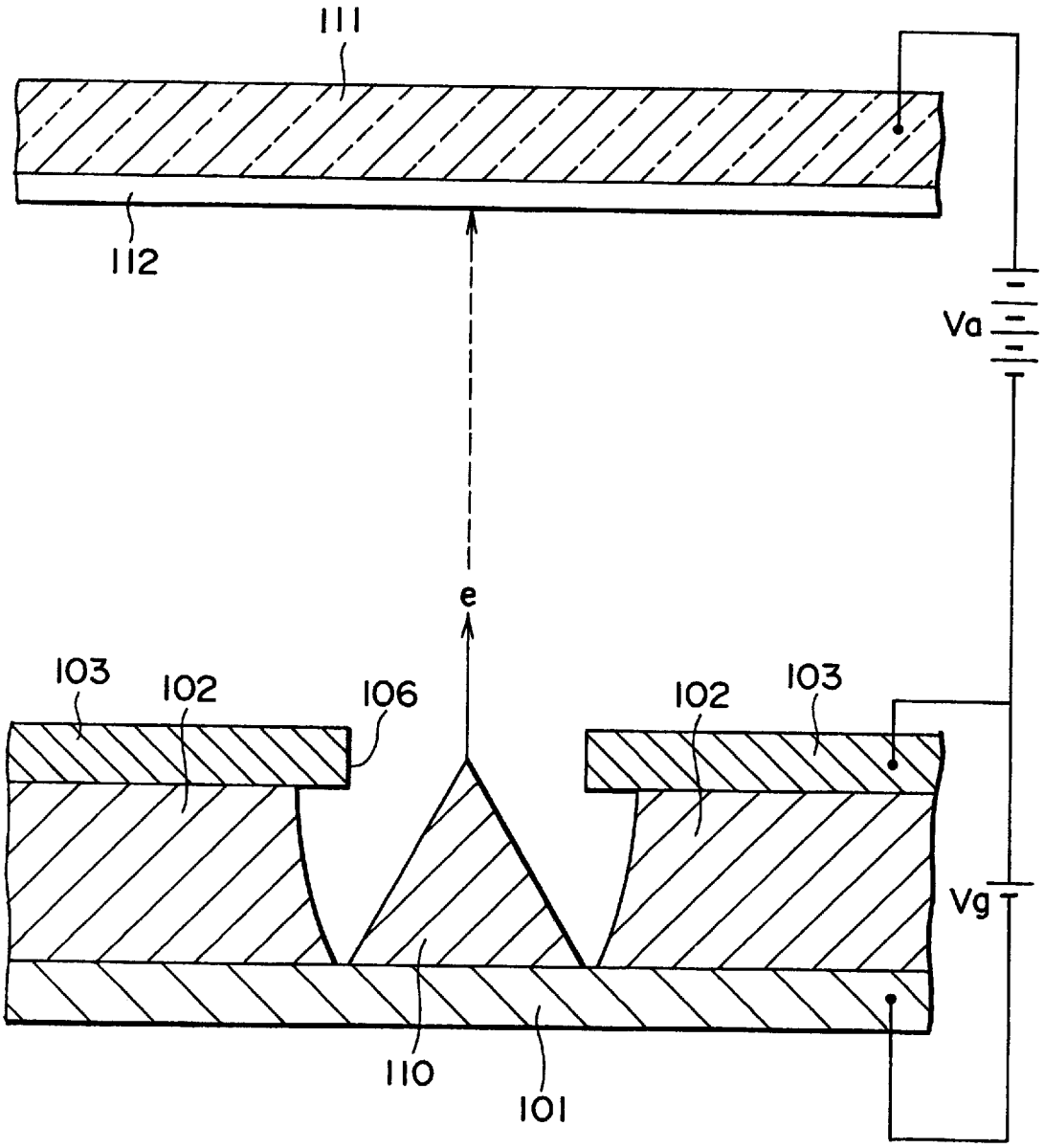
FIG. 29 is a schematic sectional view showing an essential portion of a FED in which the related art Spindt type field emission element is used as an electron source for drive of the FED.

In the case where such a field emission element is used as an electron source for drive of a FED shown in FIG. 29, a plurality of the structures shown in FIGS. 1 and 2 are arranged in a matrix pattern corresponding to a matrix pattern of pixels of the FED.

As shown in FIG. 1, according to the first embodiment, the opening 7 of the gate electrode 4 is opposed to the upper edge portion of the cathode electrode 2 at the hole 9 portion with a specific distance put therebetween. Accordingly, as shown in FIG. 1, when a voltage Vg is applied between the cathode electrode 2 and the gate electrode 4, there occurs concentration of electrons at the edge of the upper edge portion of the cathode electrode 2, to allow electrons to be emitted from the edge.

At this time, since the hole 9 of the cathode electrode 2 is formed in self-alignment into the shape being substantially the same as that of the opening 7 of the gate electrode 4, the distance between the gate electrode 4 and the upper edge portion of the cathode electrode 2 can be relatively easily, uniformly controlled only by adjustment of the thickness of the insulating layer 3.

Figure 5:
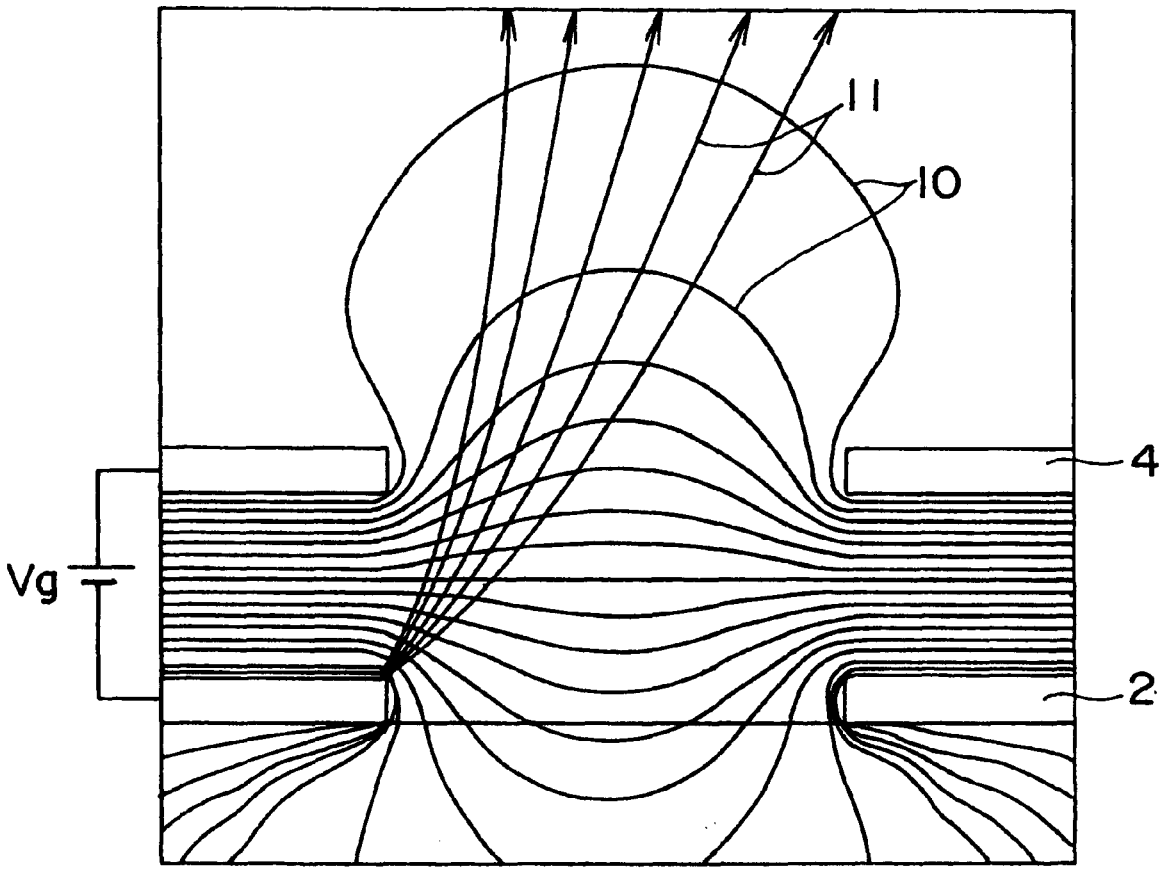
FIG. 5 is a schematic view showing an experimental result of simulating emission of electrons from the field emission element in the first embodiment of the present invention.

FIG. 5 shows a result of simulating the above field emission. For example, when a voltage of $V_g$=60 to 120 V is applied, equi-potential surfaces 10 are formed as shown in the figure, and electrons 11 are emitted from the upper edge portion of the cathode electrode 2 at which there occurs concentration of electric field. While the figure depicts the electrons 11 emitted only from one side of the upper edge portion of the cathode electrode 2, the electrons are actually emitted from the other side of the upper edge portion of the cathode electrode 2.

In this way, to efficiently emit electrons from the upper edge portion of the cathode electrode 2 opposed to the opening 7 of the gate electrode 4, the sectional shape of the upper edge portion of the cathode electrode 2 is important.

Figure 3:
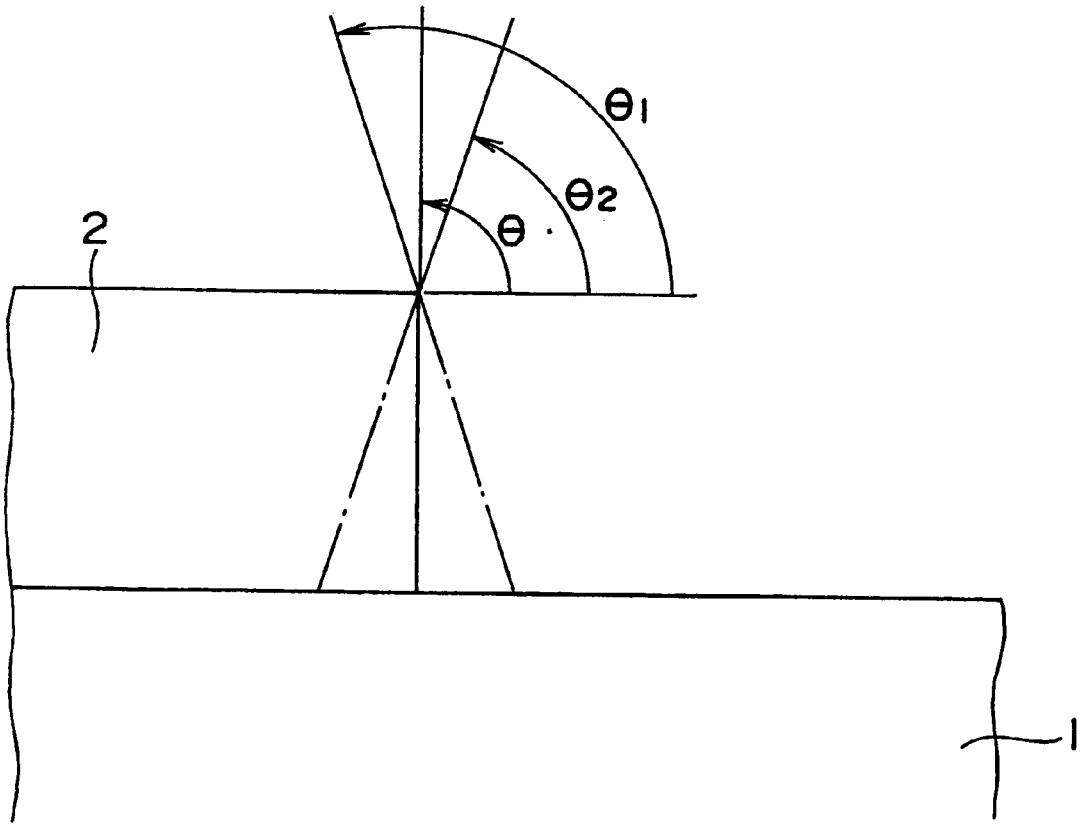
FIG. 3 is a sectional view illustrating an edge angle of the field emission element in the first embodiment of the present invention.

As shown in FIG. 3, the edge angle θ of the upper edge portion of the cathode electrode 2 may be approximately 90°. If the edge angle is on the obtuse angle side, for example θ1 or on the acute angle side, for example θ2 as shown in FIG. 3, the emission efficiency of electrons is reduced. In order to obtain a desired emission efficiency of electrons, the edge angle θ of the upper edge portion is preferably in a range of 80 to 100°.

The edge angle θ of approximately 90° can be obtained by forming the hole 9 of the cathode electrode 2 by etching with strong anisotropy, just as in the above-described fabrication method.

Figure 6A:
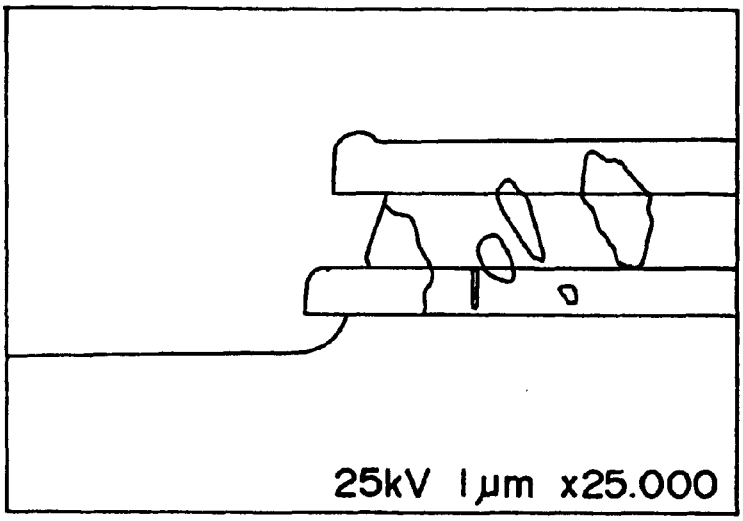
FIGS. 6A and 6B are views prepared on the basis of electron-microscopic photographs for a field emission element in which an edge of a cathode electrode is substantially upright and a field emission element in which an edge portion of a cathode electrode is tapered, respectively.
Figure 6B:
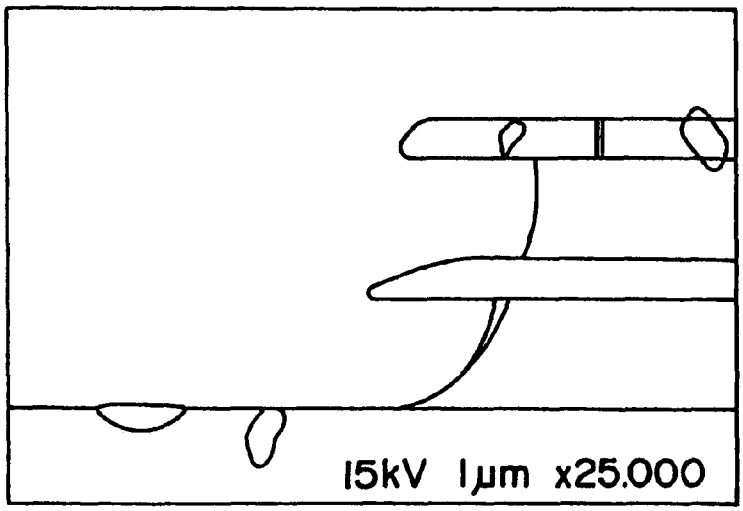

FIGS. 6A and 6B are views depicted based on sectional SEM photographs of an inventive sample of the field emission element and a comparative sample, respectively.

The inventive sample is prepared as follows. A hole pattern as an opening pattern is formed in a resist at a position where a gate electrode crosses a cathode electrode through an insulating layer. At this time, a side wall of the resist in the hole pattern is formed to be upright. Then, the gate electrode made from Cr is etched using a mixed gas of $Cl_2$ and $O_2$ at an RF power of 200 W and a pressure of 10 Pa; the insulating layer made from $SiO_2$ is etched using a mixed gas of $CHF_3$ and $O_2$ at an RF power of 200 W and a pressure of 5 Pa; and the cathode electrode made from W is etched using $SF_6$ at a RF power of 200 W and a pressure of 5 Pa. Then, the side wall of the insulating layer is etched by hydrofluoric acid, to expose an edge portion of the cathode electrode, followed by removal of the resist.

The view based on the sectional SEM photograph of the inventive sample thus prepared is shown in FIG. 6A, in which the edge of the upper edge portion of the cathode electrode is formed substantially at a right angle.

In addition, FIG. 6B shows a view based on the sectional SEM photograph of a comparative sample in which an exposed end surface of the cathode electrode is tapered (that is, the edge angle of the upper edge portion of the cathode electrode is on the obtuse angle side). The structure shown in FIG. 6B is proved to be relatively poor in emission efficiency of electrons.

As described above, the field emission element in accordance with the first embodiment is allowed to efficiently emit electrons with a relatively simple structure in which holes are continuously formed in the gate electrode 4, insulating layer 3, and cathode electrode 2. Further, since the distance between the gate electrode 4 and the upper edge portion (as the field emission portion) of the cathode electrode 2 at the hole 9 portion is relatively easily, uniformly controlled only by adjustment of the thickness of the insulating layer 3, the field emission element in this embodiment can be suitably used for a large-area display.

In the field emission element in this embodiment, there is no need of peeling a metal vapor-deposition layer upon fabrication of the element as in the related art method. As a result, it is possible to eliminate the problem of contamination of the element due to peeling of the metal vapor-deposition film, and hence to improve the fabricating yield resulting in the reduced cost.

Further, in the field emission element in this embodiment, since the distance between the gate electrode 4 and the upper edge portion (as the field emission portion) of the cathode electrode 2 at the hole 9 portion is controlled only by adjustment of the thickness of the insulating film 3, the design of the field emission element can be easily changed only by varying the thickness of the insulating layer 3. This makes it possible to improve a degree of freedom of the design of the field emission element.

In the first embodiment, the positional relationship between the gate electrode 4 and the cathode electrode 2 may be reversed to that in the embodiment. To be more specific, the gate electrode 4 may be formed on the substrate 1 side and the cathode electrode 2 may be laminated on the gate electrode 4 through the insulating layer 3. In this case, electrons emitted from the cathode electrode 2 are directed to the substrate 1 side, and accordingly, for example, the field emission element may be configured that the electrons collide with a phosphor screen provided on the back side of the substrate 1 through a through-hole 12 (indicated by a chain line in FIG. 1) provided in the substrate 1.

Embodiment 2

Figure 7:
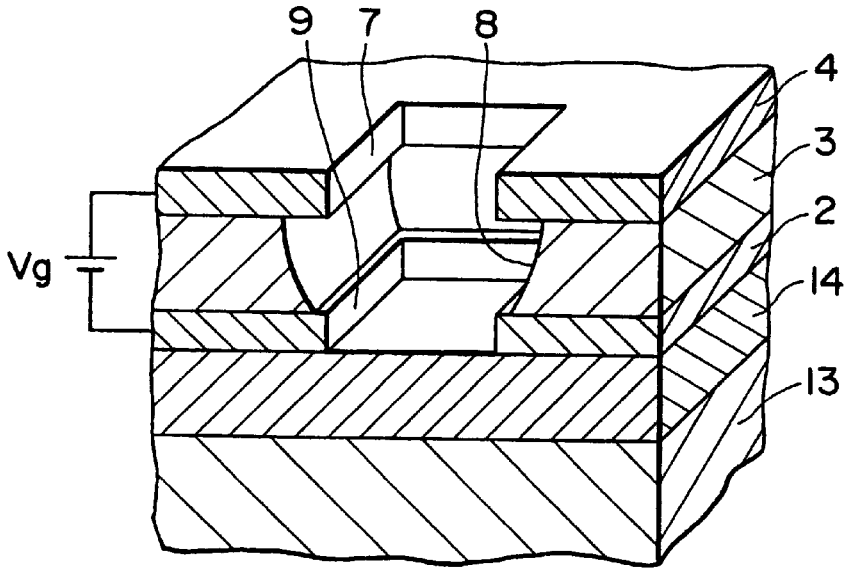
FIG. 7 is a sectional view showing a structure of a field emission element in accordance with a second embodiment of the present invention.

FIG. 7 shows a sectional structure of a field emission element in accordance with a second embodiment of the present invention. It this embodiment, parts corresponding to those in the first embodiment are indicated by the same characters as those in the first embodiment.

As shown in FIG. 7, in accordance with this embodiment, a laminated structure having a cathode electrode 2, an insulating layer 3, and a gate electrode 4, which structure is the same as that in first embodiment, is formed on a conductive substrate 13 made from a metal or a semiconductor substrate 13 made from silicon through an insulating layer 14. As a result, the field emission element in this embodiment exhibits a function and an effect which are substantially the same as those in the first embodiment.

According to the second embodiment, the field emission element can be formed in a on-chip manner, and for example, the field emission element can be of a one-chip structure with a control circuit or the like of a FED.

Embodiment 3

Figure 8:
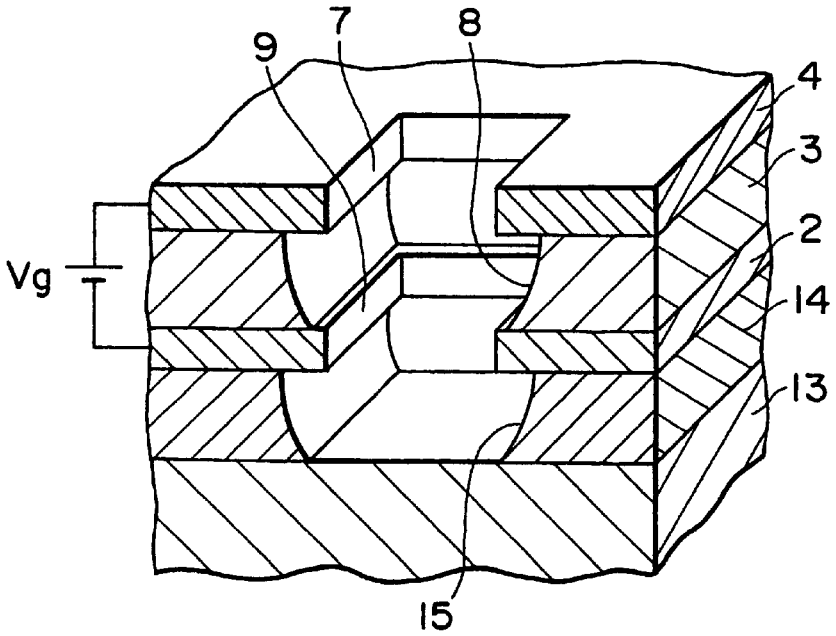
FIG. 8 is a sectional view showing a structure of a field emission element in accordance with a third embodiment of the present invention.

FIG. 8 shows a sectional structure of a field emission element in accordance with a third embodiment of the present invention. In this embodiment, parts corresponding to those in the first and second embodiments are indicated by the same characters as those in the first and second embodiments.

As shown in FIG. 8, in this embodiment, a hole 15 is formed, in an insulating layer 14 being the same as the insulating layer 14 in the second embodiment, at a position under a hole 9 of a cathode electrode 2. With this configuration, equi-potential surfaces due to an electric field from the gate electrode 4 are formed substantially uniformly even on the lower side of the cathode electrode 2, to thereby improve the emission efficiency of electrons.

The hole 15 formed in the insulating layer 14 may be a hole not passing through the insulating layer 14.

In accordance with this embodiment, like the first embodiment, the positional relationship between the gate electrode 4 and the cathode electrode 2 may be reversed to that in this embodiment.

Next, a method of fabricating the structure in the third embodiment will be described with reference to FIGS. 9A to 9E.

Figure 9A:
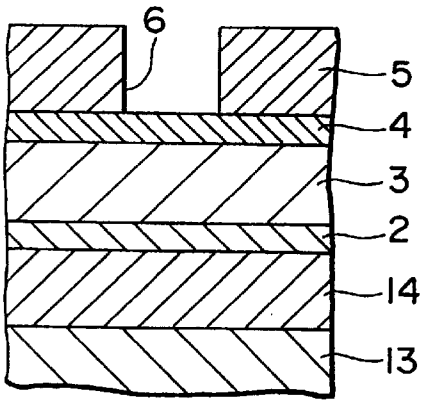
FIGS. 9A to 9E are sectional views showing sequential steps of fabricating the field emission element in the third embodiment of the present invention.

As shown in FIG. 9A, an insulating layer 14 made from silicon oxide, silicon nitride or the like is formed by CVD on a conductive substrate 13 made from a metal or a semiconductor substrate 13 made from single crystal silicon to a thickness of about 200 nm to 1 μm. A cathode electrode 2, having a specific pattern, made from a metal material such as W, Nb, Ta, Mo or Cr or a semiconductor material such as diamond, is formed by CVD or sputtering on the insulating layer 14 to a thickness of about 50 to 300 nm. An insulating layer 3 made from silicon oxide, silicon nitride or the like is formed by CVD on the cathode electrode 2 to a thickness of about 200 nm to 1 μm. A gate electrode 4 made from a metal material such as W, Nb, Ta, Mo or Cr is formed by CVD or sputtering on the insulating layer 3 to a thickness of about 50 to 300 nm, and then processed into a specific pattern crossing the pattern of the cathode electrode 2.

A resist film 5 is formed on the gate electrode 4, and an opening 6 having a specific shape is formed in the resist film 5 by photolithography.

Figure 9B:
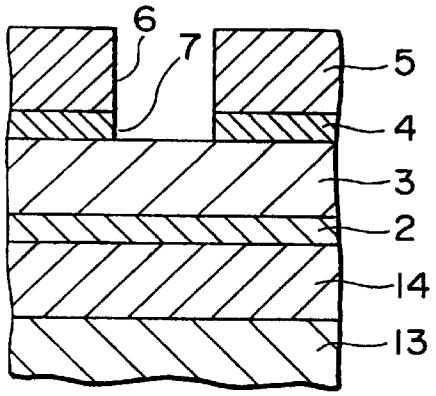

As shown in FIG. 9B, the gate electrode 4 is etched by RIE using the resist film 5 having the opening 6 as an etching mask, to form in the gate electrode 4 an opening 7 having a shape corresponding to that of the opening 6 of the resist film 5.

Figure 9C:
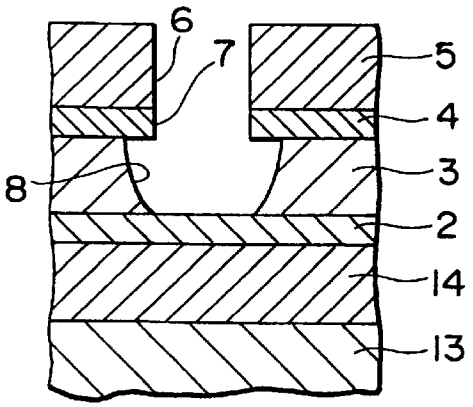

As shown in FIG. 9C, the insulating film 3 is etched by RIE or by use of hydrofluoric acid through the opening 6 of the resist film 5 and the opening 7 of the gate electrode 4, to form in the insulating film 3 a through-hole 8 reaching the cathode electrode 2. At this time, the insulating film 3 is side-etched somewhat, so that as shown in FIG. 9C, the through-hole 8 is slightly wider than the opening 7 of the gate electrode 4.

Figure 9D:
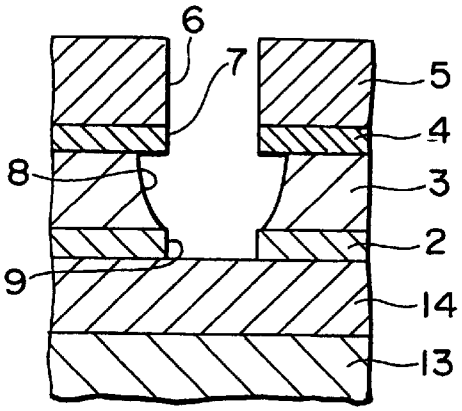

As shown in FIG. 9D, the cathode electrode 2 is etched by RIE through the opening 6 of the resist film 5, the opening 7 of the gate electrode 4, and the through-hole 8 of the insulating layer 3, to form a hole 9 in the cathode electrode 2. At this time, since the etching (RIE in this embodiment) for the cathode electrode 2 is strong in anisotropy, the hole 9 is formed into a planar shape being substantially the same as that of the opening 7 of the gate electrode 4, and further, an edge of an upper edge portion of the cathode electrode 2 at the hole 9 portion is formed into an approximately upright shape.

A structure equivalent to the structure in the second embodiment shown in FIG. 7 is obtained by the above steps shown in FIGS. 9A to 9D.

Figure 9E:
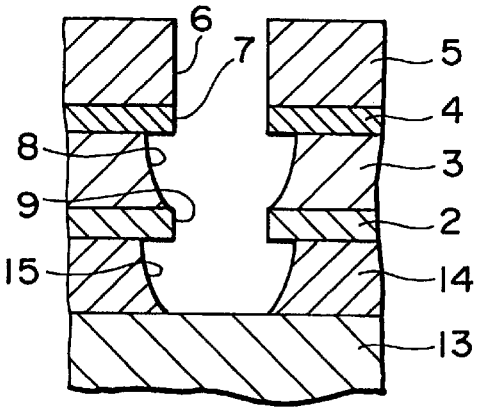

Next, as shown in FIG. 9E, the insulating layer 14 is etched by RIE or by use of hydrofluoric acid through the opening 6 of the resist film 5, the opening 7 of the gate electrode 4, the though-hole 8 of the insulating layer 3, and the hole 9 of the cathode electrode 2, to form a hole 15 in the insulating layer 14. At this time, the insulating layer 14 is side-etched somewhat, so that as shown in FIG. 9E, the hole 15 is slightly wider than the hole 9 of the cathode electrode 2.

The resist film 5 is then removed by ashing or the like, to thus obtain a structure in the third embodiment shown in FIG. 8.

Embodiment 4

Figure 10:
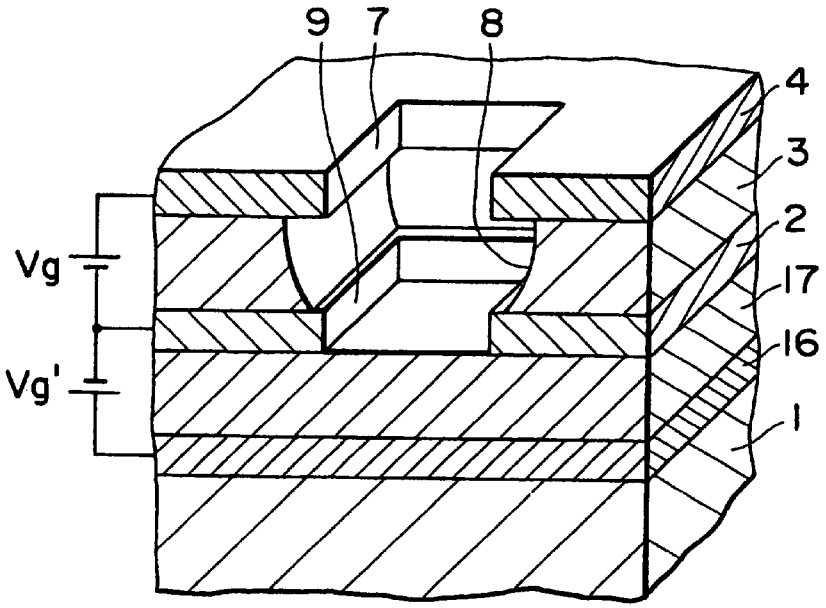
FIG. 10 is a sectional view showing a structure of a field emission element in a fourth embodiment of the present invention.

FIG. 10 shows a sectional structure of a field emission element in accordance with a fourth embodiment of the present invention. In this embodiment, parts corresponding to those in the first embodiment are indicated by the same characters as those in the first embodiment.

As shown in FIG. 10, in this embodiment, a second gate electrode 16 made from a metal material such as W, Nb, Ta, Mo or Cr is provided on an insulating substrate 1, and a laminated structure having a cathode electrode 2, an insulating layer 3 and a gate electrode 4, which structure is the same as that in the first embodiment, is formed on the second gate electrode 16 through an insulating layer 17.

In the fourth embodiment, to emit electrons from the cathode electrode 2, as shown in FIG. 10, a specific voltage $Vg'$ ($0<|Vg'|\leqq|Vg|$) is applied even between the cathode electrode 2 and the second gate electrode 16 in the direction in which the second gate electrode 16 acts as an anode and the cathode electrode 2 acts as a cathode. With this configuration, the emission efficiency of electrons from the cathode electrode 2 is improved, and the electrons in a large amount emitted from the cathode electrode 2 are introduced to a phosphor screen by an electric field generated between the cathode electrode 2 and an anode (not shown in FIG. 10: see FIG. 29) of a FED. Accordingly, the field emission element in this embodiment makes it possible to drive the FED at a lower voltage applied to the field emission element.

Embodiment 5

Figure 11:
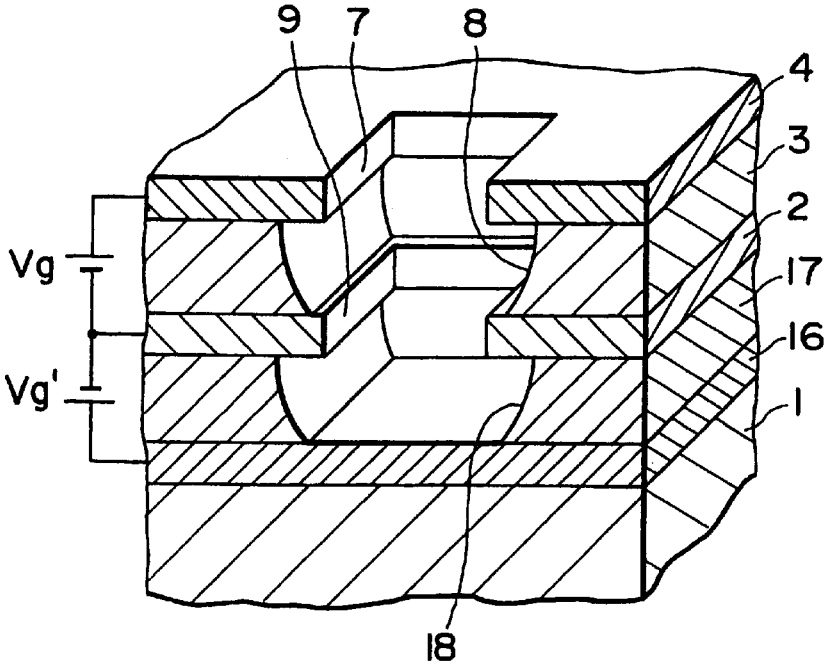
FIG. 11 is a sectional view showing a structure of a field emission element in accordance with a fifth embodiment of the present invention.

FIG. 11 shows a sectional structure of a field emission element in accordance with a fifth embodiment of the present invention. In this embodiment, parts corresponding to those in the first and fourth embodiment are indicated by the same characters as those in the first and fourth embodiments.

As shown in FIG. 11, in this embodiment, a hole 18 is formed, in an insulating layer 17 which is the same as the insulating layer 17 in the fourth embodiment, at a position under a hole 9 of a cathode electrode 2. With this configuration, equi-potential surfaces due to an electric field from the gate electrode 4 and the second gate electrode 16 are formed substantially uniformly even on the lower side of the cathode electrode 2, to thus improve the emission efficiency of electrons.

In addition, the hole 18 formed in the insulating layer 17 may be a hole not passing through the insulating layer 17.

Embodiment 6

Figure 12:
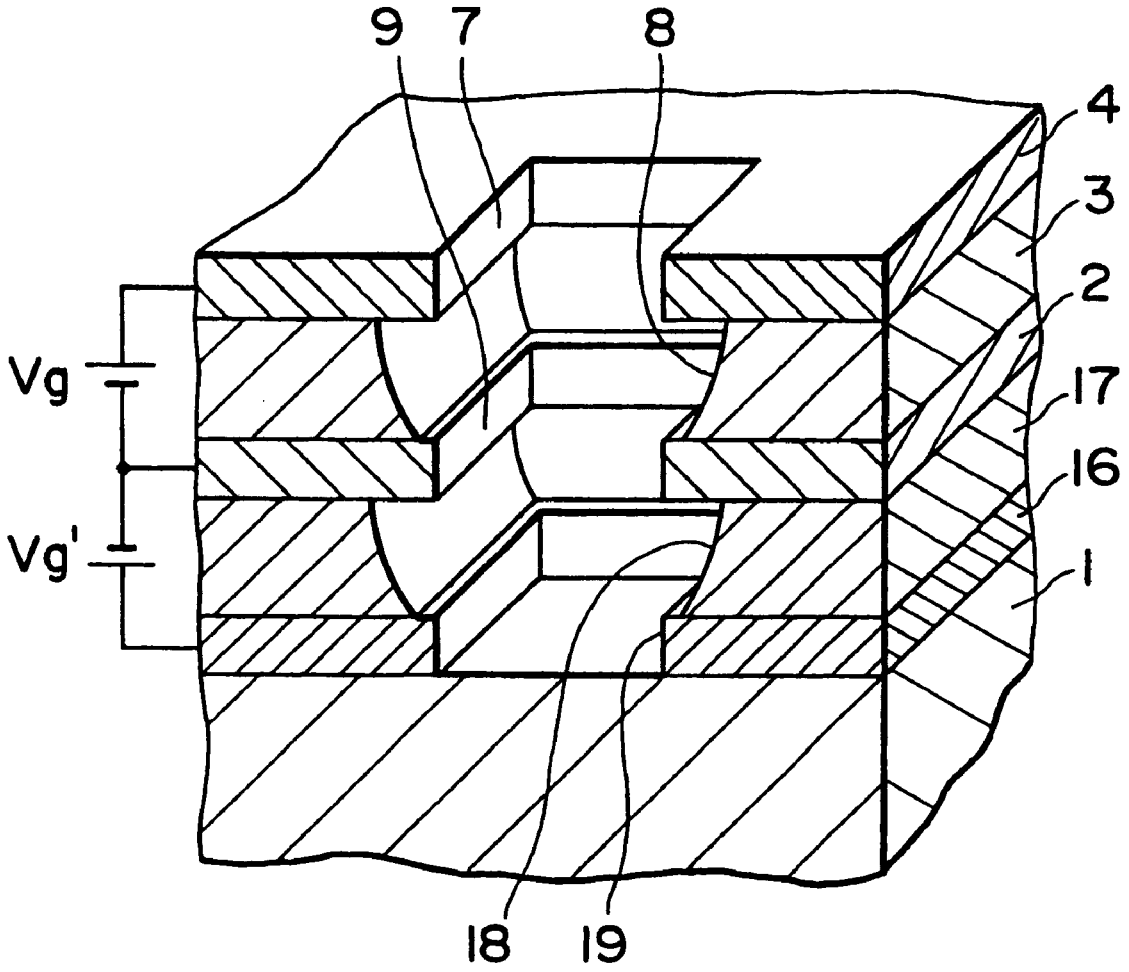
FIG. 12 is a sectional view showing a structure of a field emission element in accordance with a sixth embodiment of the present invention.

FIG. 12 shows a sectional structure of a field emission element in accordance with a sixth embodiment of the present invention. In this embodiment, parts corresponding to those in the first, fourth and fifth embodiments are indicated by the same characters as those in the first, fourth and fifth embodiments.

As shown in FIG. 12, in this embodiment, a hole 19 continuous to a hole 18 of an insulating layer 17 is formed even in a second gate electrode 16 which is the same as the second gate electrode 16 in the fifth embodiment. With this configuration, structures on the upper and lower sides of the cathode electrode 2 are substantially symmetric each other, so that equi-potential surfaces due to an electric field from the gate electrode 4 and the second gate electrode 16 are formed substantially symmetrically on the upper end lower sides of the cathode electrode 2, to thus improve the emission efficiency of electrons.

In addition, the hole 19 formed in the second gate electrode 16 may be a hole not passing through the second gate electrode 16.

Next, a method of fabricating the field emission element in the sixth embodiment will be described with reference to FIGS. 13A to 13D.

Figure 13A:
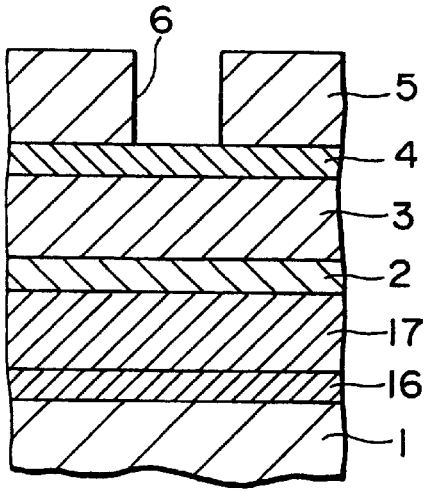
FIGS. 13A to 13D are sectional views showing sequential steps of fabricating the field emission element in the sixth embodiment of the present invention.

First, as shown in FIG. 13A, a second gate electrode 16, having a specific pattern, made from a metal material such as W, Nb, Ta, Mo or Cr, is formed by CVD or sputtering on an insulating substrate 1 represented by a glass substrate to a thickness of about 50 to 300 nm. An insulating layer 17 made from silicon oxide, silicon nitride or the like is formed by CVD on the second gate electrode 16 to a thickness of about 200 nm to 1 $\mu$m. A cathode electrode 2, having a specific pattern, made from a metal material such as W, Nb, Ta, Mo or Cr or a semiconductor material such as diamond is formed by CVD or sputtering on the insulating layer 17 to a thickness of 50 to 300 nm. An insulating layer 3 made from silicon oxide, silicon nitride or the like is formed by CVD on the cathode electrode 2 to a thickness of 200 nm to 1 $\mu$m. A gate electrode 4 made from a metal material such as W, Nb, Ta, Mo or Cr is formed by CVD or sputtering on the insulating layer 3 to a thickness of 50 to 300 nm, and the gate electrode 4 is then processed into a specific pattern crossing the pattern of the cathode electrode 2.

A resist film 5 is formed on the gate electrode 4, and an opening 6 having a specific shape is formed in the resist film 5 by photolithography.

Figure 13C:
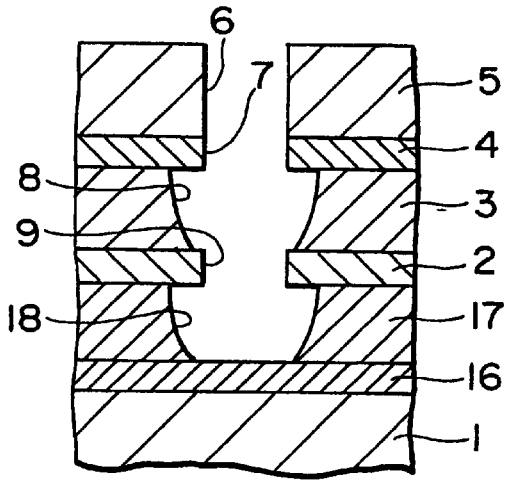
Figure 13B:
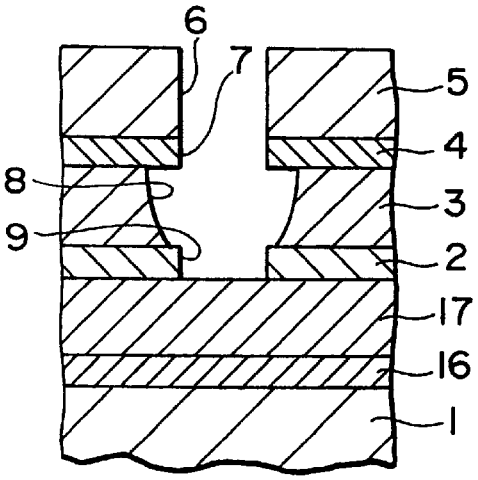

As shown in FIG. 13B, the gate electrode 4 is etched by RIE using the resist film 5 having the opening 6 as an etching mask, to form in the gate electrode 4 an opening 7 having a shape corresponding to that of the opening 6 of the resist film 5. The insulating layer 3 is etched by RIE or by use of hydrofluoric acid through the opening 6 of the resist film 5 and the opening 7 of the gate electrode 4, to form in the insulating layer 3 a through-hole 8 reaching the cathode electrode 2. At this time, the insulating layer 3 is side-etched somewhat, so that as shown in FIG. 13B, the through-hole 8 is slightly wider than the opening 7 of the gate electrode 4. Then, the cathode electrode 2 is etched by RIE through the opening 6 of the resist film 5, the opening 7 of the gate electrode 4, and the through-hole 8 of the insulating layer 3, to form a hole 9 in the cathode electrode 2. At this time, since the etching (RIE in this embodiment) for the cathode electrode 2 is strong in anisotropy, the hole 9 is formed into a planar shape being substantially the same as that of the opening 7 of the gate electrode 4, and further, an edge of an upper edge portion of the cathode electrode 2 at the hole 9 portion is formed into an approximately upright shape.

A structure equivalent to the structure described in the fourth embodiment shown in FIG. 10 is obtained by the above steps shown in FIGS. 13A and FIG. 13B.

Next, as shown in FIG. 13C, the insulating layer 17 is etched by RIE or by use of hydrofluoric acid through the opening 6 of the resist film 5, the opening 7 of the gate electrode 4, the through-hole 8 of the insulating layer 3, and the hole 9 of the cathode electrode 2, to form a hole 18 in the insulating layer 17. At this time, the insulating layer 17 is side-etched somewhat, so that as shown in FIG. 13C, the hole 18 is slightly wider than the hole 9 of the cathode electrode 2.

A structure equivalent to the structure described in the fifth embodiment shown in FIG. 11 is obtained by the steps shown in FIGS. 13A, 13B and 13C.

Figure 13D:
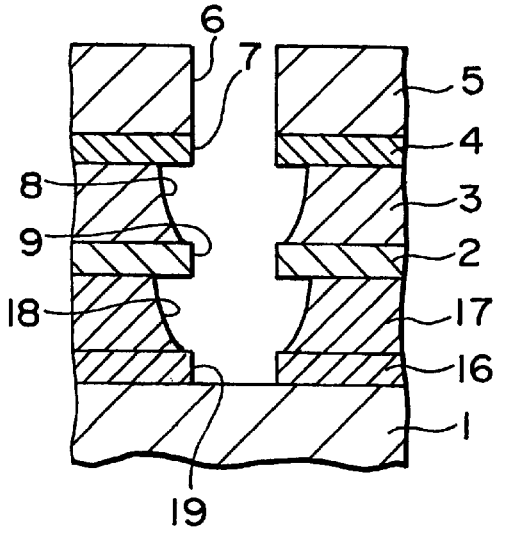

Next, as shown in FIG. 13D, the second gate electrode 16 is etched by RIE through the opening 6 of the resist film 5, the opening 7 of the gate electrode 4, the through-hole 8 of the insulating layer 3, the hole 9 of the cathode electrode 2, and the hole 18 of the insulating layer 17, to form a hole 19 in the second gate electrode 16. At this time, since the etching (RIE in this embodiment) for the second gate electrode 16 is strong in anisotropy, the hole 19 is formed into a planar shape being substantially the same as those of the opening 7 of the gate electrode 4 and the hole 9 of the cathode electrode 2.

The resist film 5 is then removed by ashing or the like, to obtain a structure in the sixth embodiment shown in FIG. 12.

Embodiment 7

Figure 14:
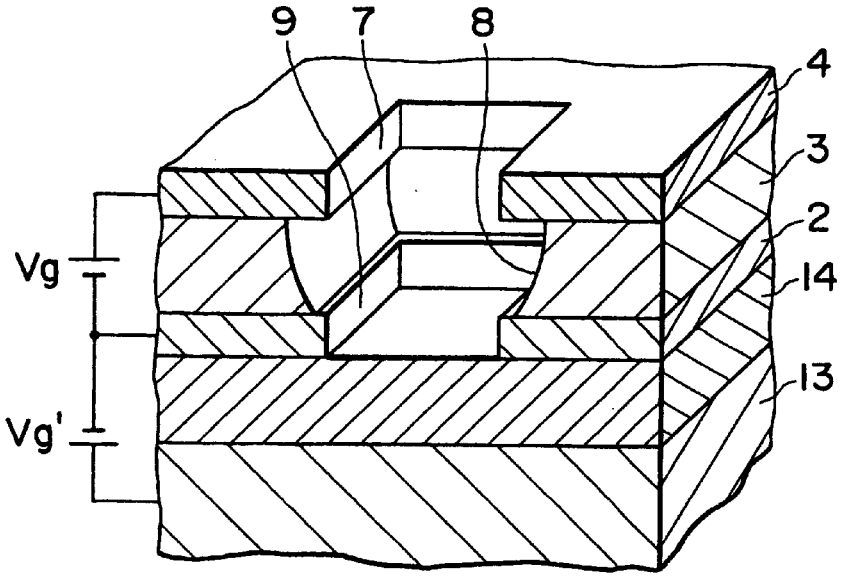
FIG. 14 is a sectional view showing a structure of a field emission element in accordance with a seventh embodiment of the present invention.

FIG. 14 shows a sectional structure of a field emission element in accordance with a seventh embodiment of the present invention. In this embodiment, parts corresponding to those in the second embodiment are indicated by the same characters as those in the second embodiment.

As shown in FIG. 14, in the seventh embodiment whose configuration is similar to that of the second embodiment shown in FIG. 7, the second gate electrode 16 in the fourth, fifth and sixth embodiment is replaced with the conductive substrate or semiconductor substrate 13. In this embodiment, to emit electrons from the cathode electrode 2, a specific voltage Vg' ($0<|Vg'|\leqq|Vg|$) is applied even between the cathode electrode 2 and the substrate 13 in the direction in which the substrate 13 acts as an anode and the cathode electrode 2 acts as a cathode. With this configuration, the emission efficiency of electrons from the cathode electrode 2 is improved, and a large amount of the electrons emitted from the cathode electrode 2 are introduced to a phosphor screen by an electric field between the cathode electrode 2 and an anode (not shown in the figure: see FIG. 29) of a FED.

Accordingly, in this embodiment, the same effect as that in the fourth embodiment can be obtained without provision of the second gate electrode.

Embodiment 8

Figure 15:
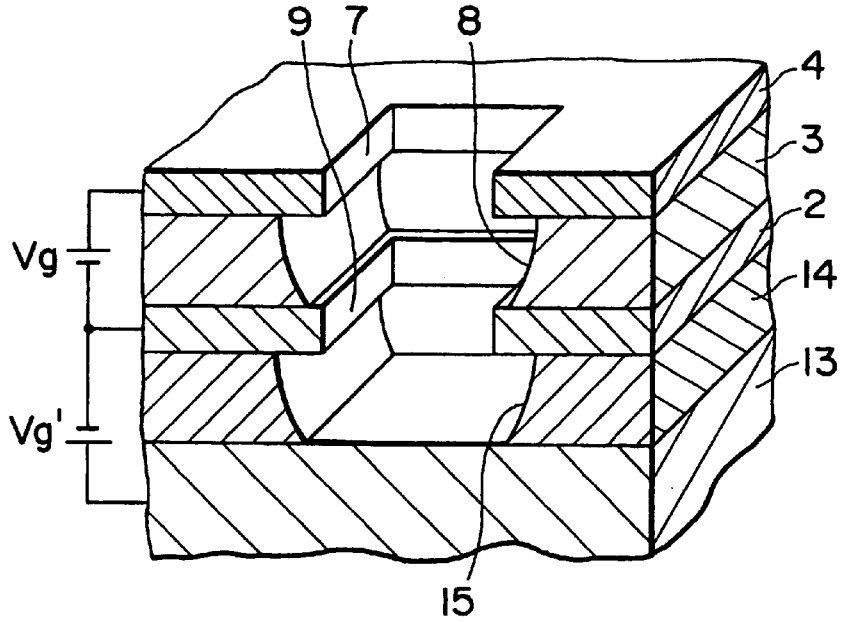
FIG. 15 is a sectional view showing a structure of a field emission element of an eighth embodiment of the present invention.

FIG. 15 shows a sectional structure of a field emission element in accordance with an eighth embodiment of the present invention. In this embodiment, parts corresponding to those in the third embodiment are indicated by the same characters as those in the third embodiment.

As shown in FIG. 15, in the eighth embodiment whose configuration is similar to that in the third embodiment shown in FIG. 8, the second gate electrode 16 in the fourth, fifth, and sixth embodiments is replaced with the conductive substrate or semiconductor substrate 13. In this embodiment, to emit electrons from the cathode electrode 2, a specific voltage Vg' ($0<|Vg'|\leqq|Vg|$) is applied even between the cathode electrode 2 and the substrate 13 in the direction in which the substrate 13 acts as an anode and the cathode electrode 2 acts as a cathode. With this configuration, the emission efficiency of electrons from the cathode electrode 2 is improved, and a large amount of the electrons emitted from the cathode electrode 2 are introduced to a phosphor screen by an electric field between the cathode electrode 2 and an anode (not shown in the figure: see FIG. 29) of a FED.

Accordingly, in this embodiment, the same effect as that in the fifth embodiment can be obtained without provision of the second gate electrode.

Embodiment 9

Figure 16A:
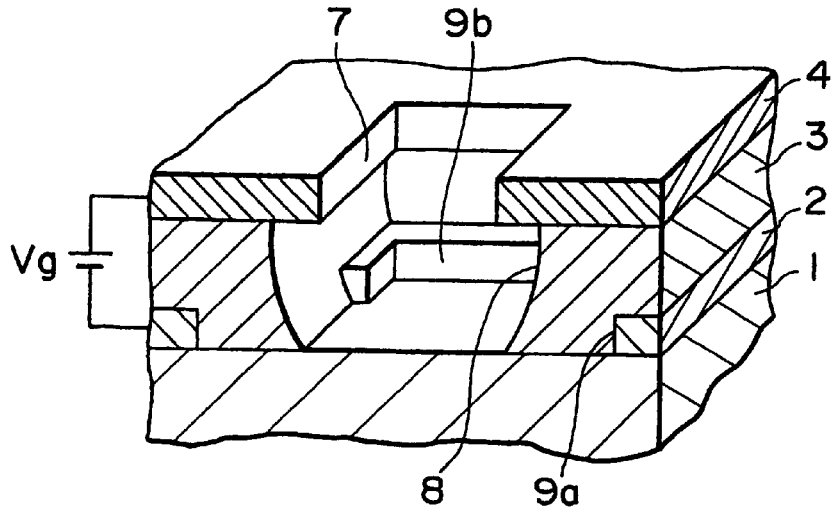
FIGS. 16A and 16B are a sectional view and an exploded view showing a structure of a field emission element in accordance with a ninth embodiment of the present invention.
Figure 16B:
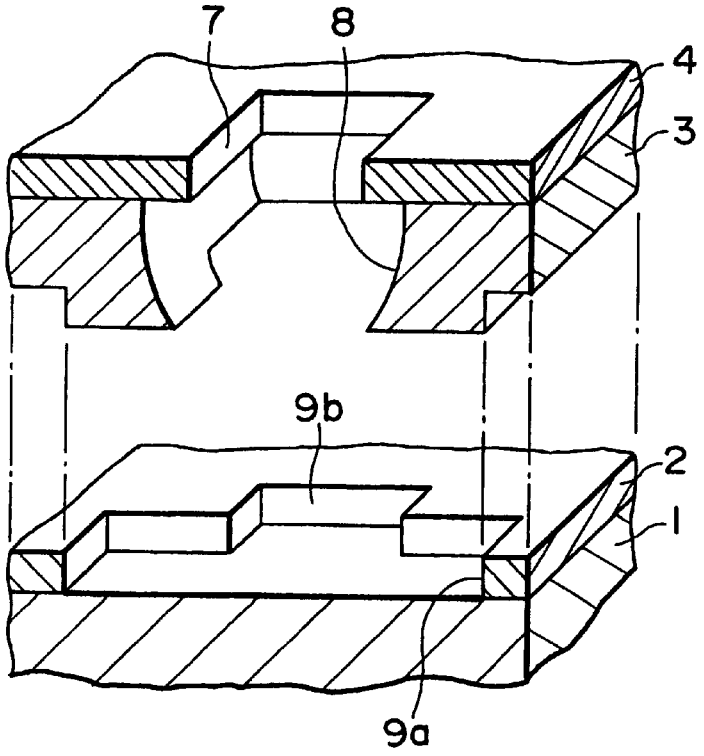
Figure 17:
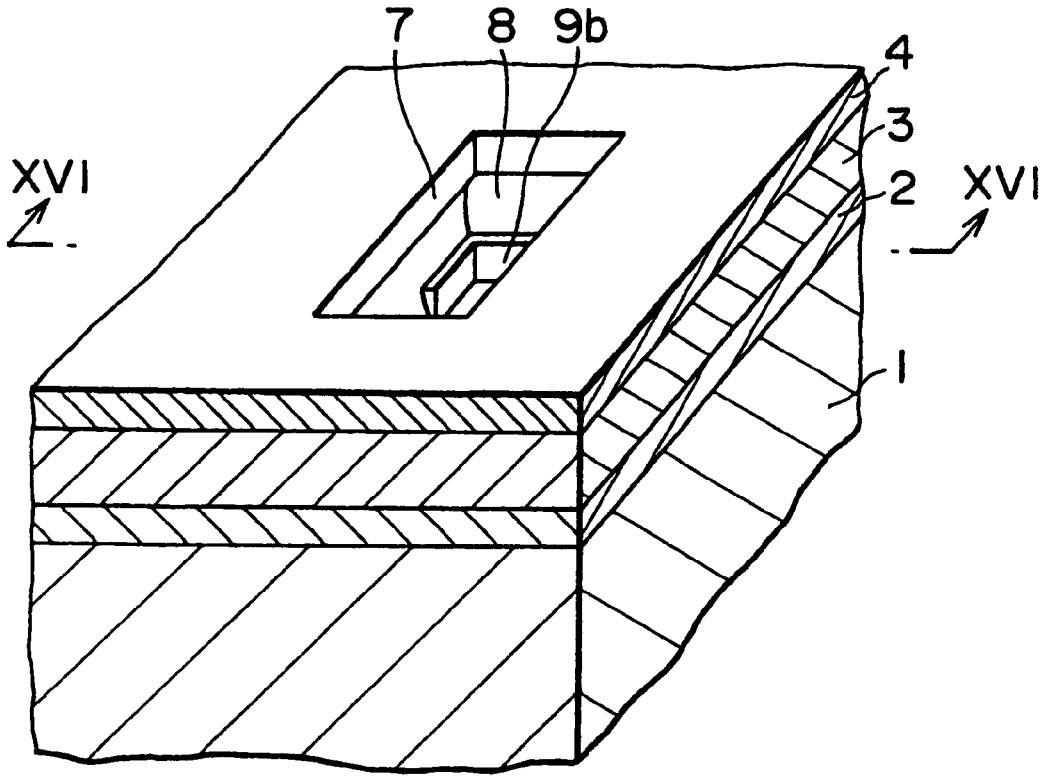
FIG. 17 is a perspective view showing an opening shape of a gate electrode of the field emission element in the ninth embodiment of the present invention.

FIGS. 16A and 16B each shows a sectional structure of a field emission element in accordance with a ninth embodiment of the present invention, and FIG. 17 shows an opening shape of a gate electrode of the field emission element shown in FIGS. 16A and 16B. In addition, FIG. 16A is a sectional view taken on line XVI—XVI of FIG. 17. In this embodiment, parts corresponding to those in the first embodiment are indicated by the same characters as those in the first embodiment.

First, a method of fabricating the field emission element in accordance with the ninth embodiment will be described with reference to FIGS. 18A-1 to 18C-2.

Figures 1, 18A:
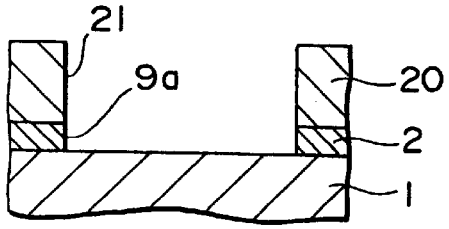
Figures 2, 18A:
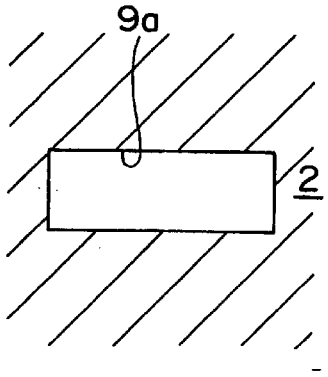

As shown in FIG. 18A-1, a cathode electrode 2, having a specific pattern, made from a metal material such as W, Nb, Ta, Mo or Cr or a semiconductor material such as diamond, is formed by CVD or sputtering on an insulating substrate 1 represented by a glass substrate to a thickness of about 50 to 300 nm.

Next, in this embodiment, a resist film 20 is formed on the cathode electrode 2, and an opening 21 having a specific shape, for example, a rectangular shape shown in FIG. 18A-2 is formed in the resist film 20 by photolithography. The cathode electrode 2 is etched by RIE using the resist film 20 having the opening 21 as an etching mask, to form in the cathode electrode 2 a hole 9*a* having a shape corresponding to that of the opening 21 of the resist film 20. At this time, since the etching (RIE in this embodiment) for the cathode electrode 2 is strong in anisotropy, an edge of an upper edge portion of the cathode electrode 2 at the hole 9*a* portion is formed into an approximately upright shape.

Figures 1, 18B:
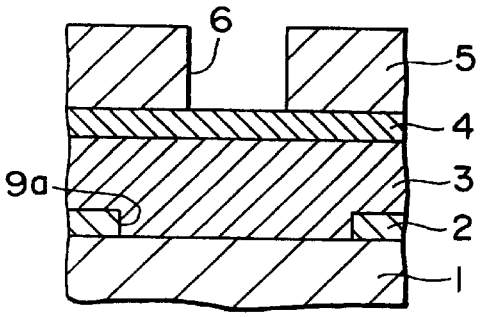
Figures 2, 18B:
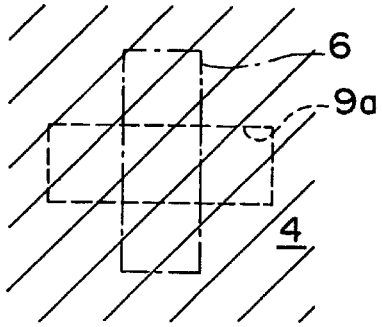

As shown in FIG. 18B-1, after the resist film 20 is removed, an insulating film 3 made from silicon oxide, silicon nitride or the like is formed on the cathode electrode 2 by CVD to a thickness of about 200 nm to 1 $\mu$m. A gate electrode 4 made from a metal material such as W, Nb, Ta, Mo or Cr is formed on the insulating layer 3 by CVD or sputtering to a thickness of about 50 to 300 nm, and the gate electrode 4 is processed into a specific pattern crossing the pattern of the cathode electrode 2.

A resist film 5 is formed on the gate electrode 4, and an opening 6 having a specific shape is formed in the resist film 5 by photolithography. At this time, the opening 6 is formed into a rectangular shape which crosses the hole 9*a* of the cathode electrode 2, as shown by the plan view of FIG. 18B-2.

Figures 1, 18C:
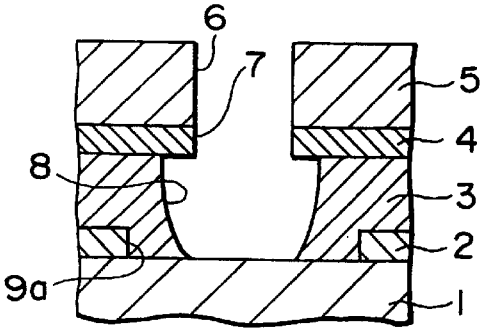
Figures 2, 18C:
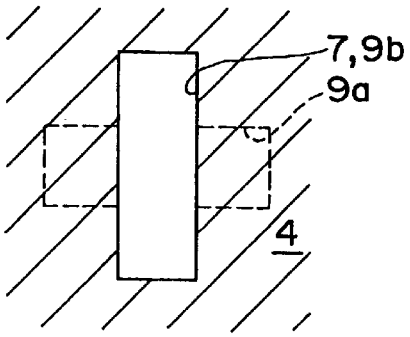

As show in FIG. 18C-1, the gate electrode 4 is etched by RIE using the resist film 5 having the opening 6 as an etching mask, to form in the gate electrode 4 an opening 7 having a shape corresponding to that of the opening 6 of the resist film 5. The insulating layer 3 is etched by RIE or by use of hydrofluoric acid through the opening 6 of the resist film 5 and the opening 7 of the gate electrode 4, to form in the insulating layer 3 a through-hole 8 reaching the cathode electrode 2 at a position not shown (see FIG. 16A). In addition, FIG. 18C-1 shows the cross-section of a portion of the cathode electrode 2 at the hole 9*a* portion, at which the through-hole 8 of the insulating layer 3 reaches the insulating substrate 1. At this time, the insulating layer 3 is side-etched somewhat, so that as shown in FIG. 18C-1, the though-hole 8 is slightly wider than the opening 7 of the gate electrode 4.

Then, the cathode electrode 2 exposed in the opening 6 of the resist film 5, the opening 7 of the gate electrode 4 and the through-hole 8 of the insulating layer 3 are etched by RIE through the openings 6, 7 and 8, to form in the cathode electrode 2 a hole 9*b* having a planar shape being substantially the same as that of the opening 7 of the gate electrode 4 as shown in FIG. 18C-2. A nearly crossed hole composed of the holes 9*a* and 9*b* is thus formed in the cathode electrode 2, as shown in FIG. 16B. At this time, since the etching (RIE in this embodiment) for the cathode electrode 2 is strong in anisotropy, the hole 9*b* is formed into a planar shape being substantially the same as that of the opening 7 of the gate electrode 4, and further, an edge of an upper edge portion of the cathode electrode 2 at the hole 9 portion is formed into an approximately upright shape.

At this time, as described above, since the through-hole 8 of the insulating layer 3 is slightly wider than the opening 7 of the gate electrode 4, like the first embodiment, the upper edge portion of the cathode electrode 2 at the hole 9*b* portion is exposed in the through-hole 8 of the insulating layer 3, To be more specific, in the ninth embodiment, as shown in FIG. 16A, corners at which the hole 9*a* crosses the hole 9*b* are exposed in the through-hole 8 of the insulating layer 3. Since each corner has angles not only in the cross-sectional direction but also in the planar direction of the cathode electrode 2, there easily occurs concentration of an electric field, thereby allowing electrons to be efficiently emitted from the corners.

In addition, each of the holes 9*a* and 9*b* formed in the cathode electrode 2 may be a hole not passing through the cathode electrode 2.

The shape of each of the holes 9*a* and 9*b* is not limited to a rectangular shape shown in the figure, and may be variously changed, for example, into an elliptic shape insofar as corners are formed at positions at which the hole 9*a* crosses the hole 9*b*.

The resist film 5 is then removed by ashing or the like, to obtain a structure shown in FIGS. 16A and 16B.

In the ninth embodiment, since electrons are emitted from the corners, of the cathode electrode 2, having angles not only in the cross-sectional direction but also in the planar direction of the cathode electrode 2, the emission efficiency of electrons is improved, with a result that the field emission element in this embodiment can be driven at a lower voltage.

Embodiment 10

Figure 19:
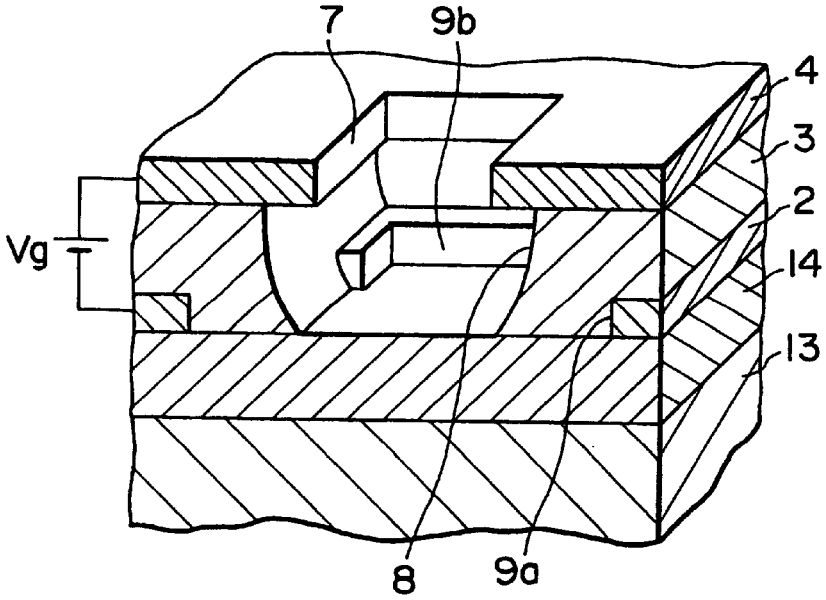
FIG. 19 is a sectional view showing a structure of a field emission element in accordance with the tenth embodiment of the present invention.

FIG. 19 shows a sectional structure of a field emission element in accordance with the tenth embodiment of the present invention. In this embodiment, parts corresponding to those in the second and ninth embodiments are indicated by the same characters as those in the second and ninth embodiments.

As shown in FIG. 19, in accordance with the tenth embodiment, like the second embodiment shown in FIG. 7, a laminated structure of a cathode electrode 2, an insulating layer 3, and a gate electrode 4, which structure is the same as that in the ninth embodiment, is formed on a conductive substrate 13 made from a metal or a semiconductor substrate 13 made from silicon through an insulating layer 14.

Accordingly, the tenth embodiment exhibits both the effects in the second and ninth embodiments.

Embodiment 11

Figure 20:
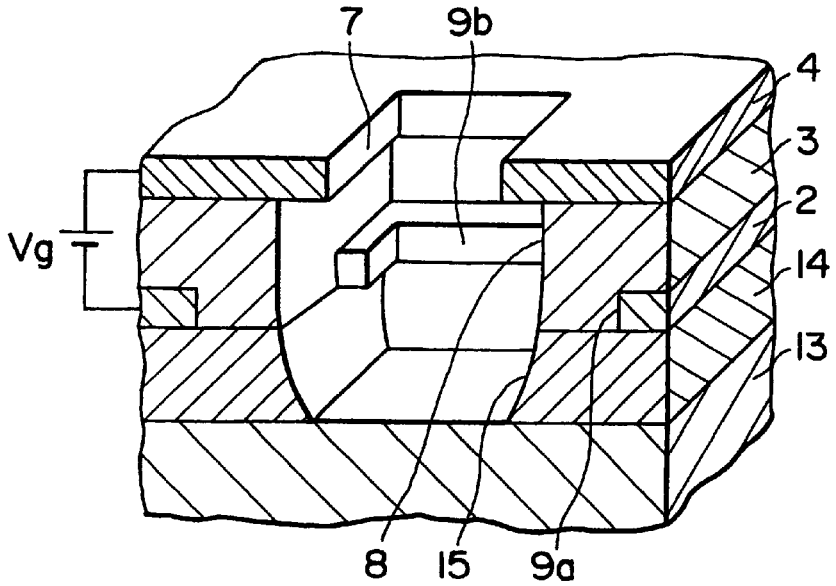
FIG. 20 is a sectional view showing a structure of a field emission element in accordance with an eleventh embodiment of the present invention.

FIG. 20 shows a sectional structure of a field emission element in accordance with an eleventh embodiment of the present invention. In this embodiment, parts corresponding to those in the third and tenth embodiments are indicated by the same characters as those in the third and tenth embodiments.

As shown in FIG. 20, in accordance with this embodiment, a hole 15 which is the same as the hole 15 in the third embodiment shown in FIG. 8 is provided in an insulating layer 14 which is the same as the insulating layer 14 in the tenth embodiment.

Accordingly, the eleventh embodiment exhibits both the effects in the third and tenth embodiments.

In addition, the hole 15 formed in the insulating layer 14 may be a hole not passing through the insulating layer 14.

Embodiment 12

Figure 21:
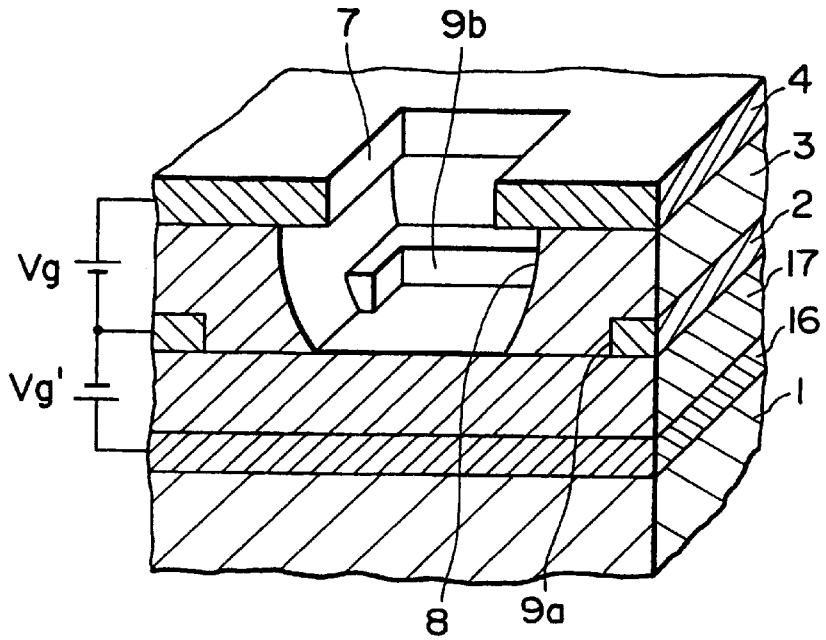
FIG. 21 is a sectional view showing a structure of a field emission element in accordance with a twelfth embodiment of the present invention.

FIG. 21 shows a sectional structure of a field emission element in accordance with a twelfth embodiment of the present invention. In this embodiment, parts corresponding to those in the fourth and ninth embodiments are indicated by the same characters as those in the fourth and ninth embodiments.

As shown in FIG. 21, in accordance with the twelfth embodiment, like the fourth embodiment shown in FIG. 10, a second gate electrode 16 made from a metal material such as W, Nb, Ta, Mo or Cr is provided on an insulating substrate 1, and a laminated structure having a cathode electrode 2, an insulating layer 3, and a gate electrode 4, which structure is the same as that in the ninth embodiment, is formed on the second gate electrode 16 through an insulating layer 17.

Accordingly, the twelfth embodiment exhibits both the effects of the fourth and ninth embodiments, and therefore, the field emission element in this embodiment can be driven at a lower voltage.

Embodiment 13

Figure 22:
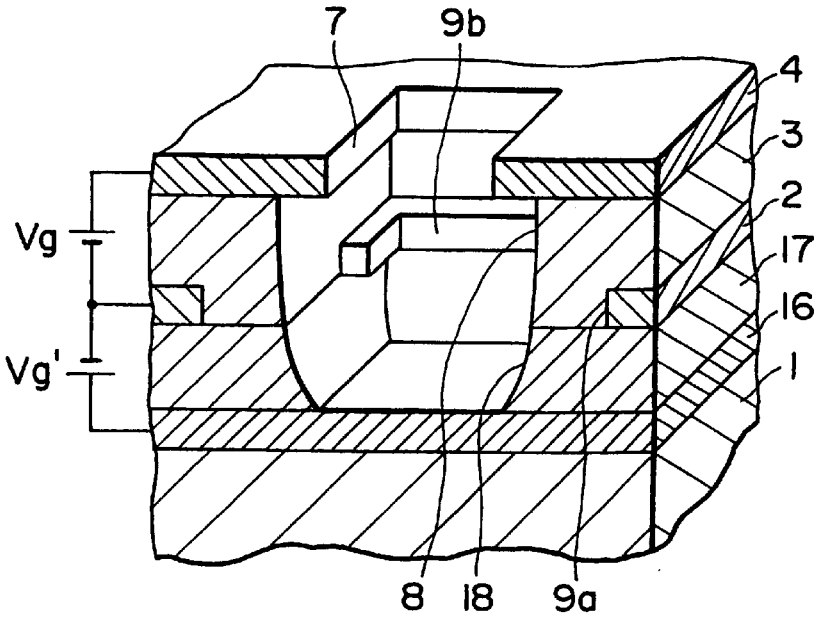
FIG. 22 is a sectional view showing a structure of a field emission element in accordance with a thirteenth embodiment of the present invention.

FIG. 22 shows a sectional structure of a field emission element in accordance with a thirteenth embodiment of the present invention. In this embodiment, parts corresponding to those in the fifth and ninth embodiments are indicated by the same characters as those in the fifth and ninth embodiments.

As shown in FIG. 22, in accordance with the thirteenth embodiment, like the fifth embodiment shown in FIG. 11, a hole 18 is formed, even in an insulating layer 17 which is the same as the insulating layer 17 in the twelfth embodiment, at a position under holes 9*a* and 9*b* of a cathode electrode 2.

Accordingly, the thirteenth embodiment exhibits both the effects of the fifth and ninth embodiments.

In addition, the hole 18 of the insulating layer 17 may be a hole not passing through the insulating layer 17.

Embodiment 14

Figure 23:
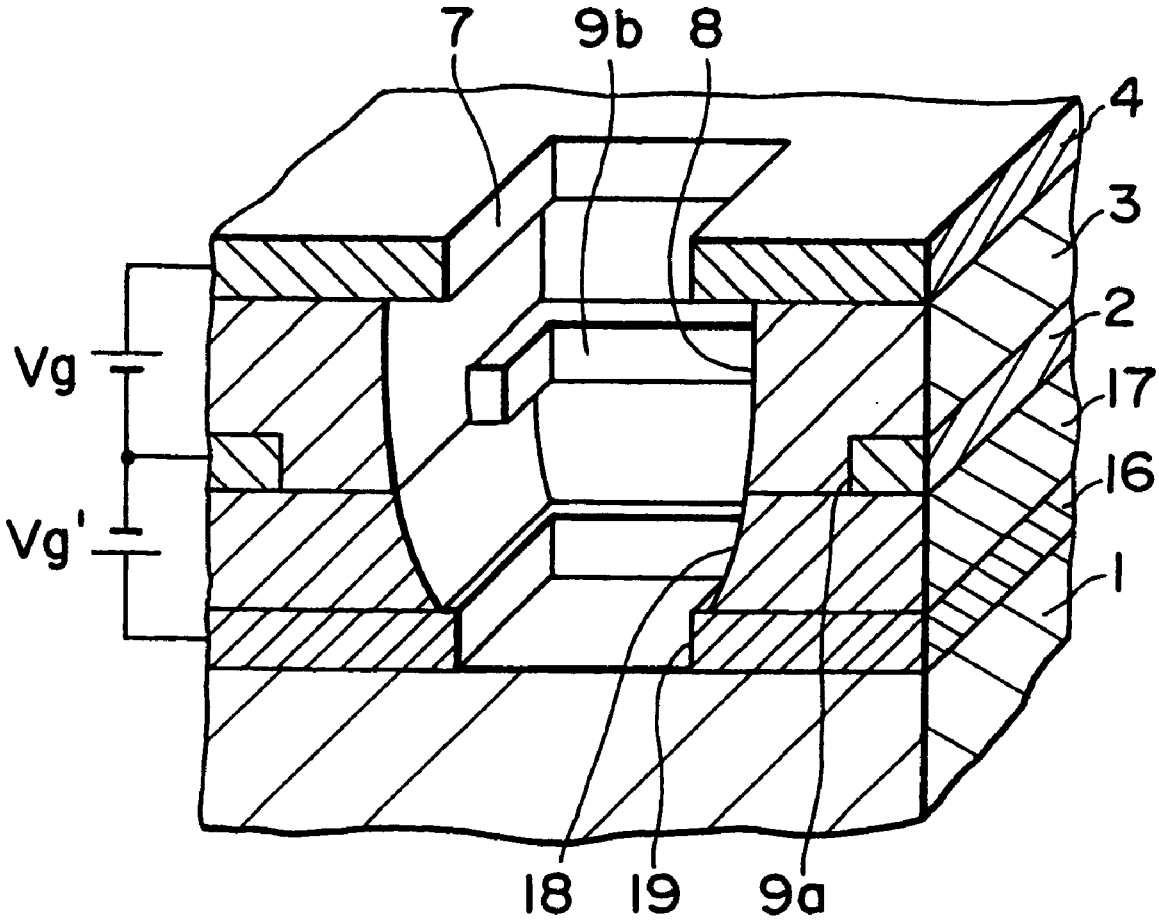
FIG. 23 is a sectional view showing a structure of a field emission element in accordance with a fourteenth embodiment of the present invention.

FIG. 23 shows a sectional structure of a field emission element in accordance with a fourteenth embodiment of the present invention. In addition, parts corresponding to those in the sixth and thirteenth embodiments are indicated by the same characters as those in the sixth and thirteenth embodiments.

As shown in FIG. 23, in accordance with the fourteenth embodiment, like the sixth embodiment shown in FIG. 12, a hole 19 continuous to a hole 18 of an insulating layer 17 is formed in a second gate electrode 16 which is the same as the second gate electrode 16 in the thirteenth embodiment.

Accordingly, the fourteenth embodiment exhibits both the effects of the sixth and thirteenth embodiments.

In addition, the hole 19 formed in the second gate electrode 16 may be a hole not passing through the second gate electrode 16.

Next, a method of fabricating a structure in the fourteenth embodiment will be described with reference to FIGS. 24A to 24F.

Figure 24A:
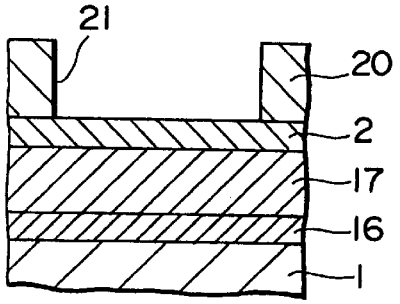
FIGS. 24A to 24F are sectional views showing sequential steps of fabricating the field emission element in the fourteenth embodiment of the present invention.

As shown in FIG. 24A, a second gate electrode 16, having a specific pattern, made from a metal material such as W, Nb, Ta, Mo or Cr, is formed by CVD or sputtering on an insulating substrate 1 represented by a glass substrate to a thickness of about 50 to 300 nm. An insulating layer 17 made from silicon oxide, silicon nitride or the like is formed by CVD on the second gate electrode 16 to a thickness of about 200 nm to 1 $\mu$m. A cathode electrode 2, having a specific pattern, made from a metal material such as W, Nb, Ta, Mo or Cr or a semiconductor material such as diamond is formed on the insulating layer 17 to a thickness of about 50 to 300 nm.

Next, like the above-described step shown in FIGS. 18A-1 and 18A-2, a resist film 20 is formed on the cathode electrode 2, and an opening 21 having a specific shape is formed in the resist film 20 by photolithography.

Figure 24B:
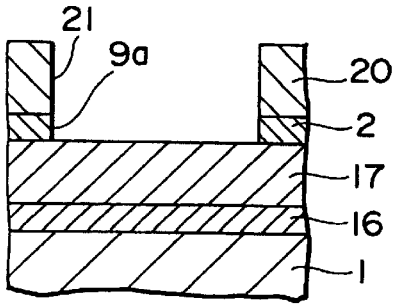

Then, as shown in FIG. 24B, the cathode electrode 2 is etched by RIE using the resist film 20 having the opening 21 as an etching mask, to form in the cathode electrode 2 a hole 9*a* having a shape corresponding to that of the opening 21 of the resist film 20. At this time, since the etching (RIE in this embodiment) for the cathode electrode 2 is strong in anisotropy, an edge of an upper edge portion of the cathode electrode 2 at the hole 9*a* portion is formed into an approximately upright shape.

Figure 24C:
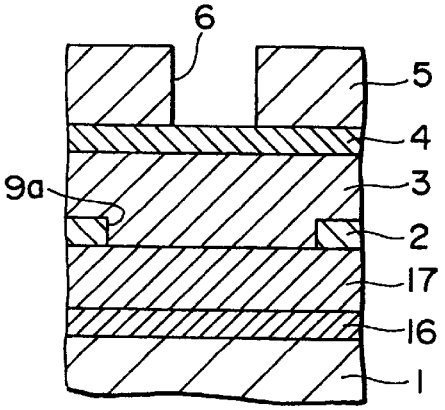

As shown in FIG. 24C, an insulating layer 3 made from silicon oxide, silicon nitride or the like is formed by CVD on the cathode electrode 2 to a thickness of about 200 nm to 1 $\mu$m. A gate electrode 4 made from a metal material such as W, Nb, Ta, Mo or Cr is formed by CVD or sputtering on the insulating layer 3 to a thickness of about 50 to 300 nm, and the gate electrode 4 is then processed into a specific pattern crossing the pattern of the cathode electrode 2.

Next, like the above-described step shown in FIGS. 18B-1 and 18B-2, a resist film 5 is formed on the gate electrode 4, and an opening 6 having a specific shape is formed in the resist film 5 by photolithography.

Figure 24D:
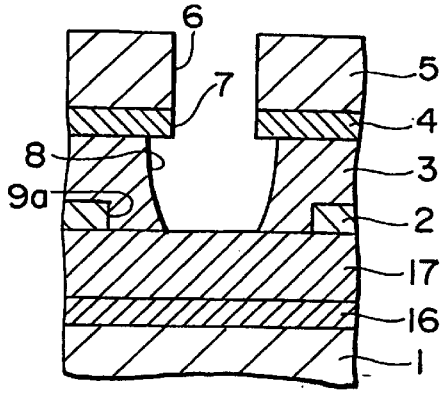

Then, as shown in FIG. 24D, the gate electrode 4 is etched by RIE using the resist film 5 having the opening 6 as an etching mask, to form in the gate electrode 4 an opening 7 having a shape corresponding to that of the opening 6 of the resist film 5. The insulating layer 3 is etched by RIE or by use of hydrofluoric acid through the opening 6 of the resist film 5 and the opening 7 of the gate electrode 4, to form in the insulating layer 3 a through-hole 8 reaching the cathode electrode 2 at a position not shown. At this time, since the insulating layer 3 is side-etched somewhat, the through-hole 8 is slightly wider than the opening 7 of the gate electrode 4, as shown in FIG. 24D.

Then, the cathode electrode 2 exposed in the opening 6 of the resist film 5, the opening 7 of the gate electrode 4, and the through-hole 8 of the insulating layer 3 is etched by RIE through the opening 6, 7 and 8, to form in the cathode electrode 2 a hole 9*b* having a planar shape being substantially the same as that of the opening 7 of the gate electrode 4. That is, a nearly crossed hole composed of the holes 9*a* and 9*b* is formed in the cathode electrode 2. At this time, since the etching (RIE in this embodiment) for the cathode electrode 2 is strong in anisotropy, the hole 9*b* is formed into the planar shape being substantially the same as that of the opening 7 of the gate electrode 4, and further, an edge of an upper edge portion of the cathode electrode 2 at the hole 9*b* portion is formed into an approximately upright shape.

With the above steps shown in FIGS. 24A to 24D, a structure equivalent to the structure in the twelfth embodiment shown in FIG. 21 is obtained.

Figure 24E:
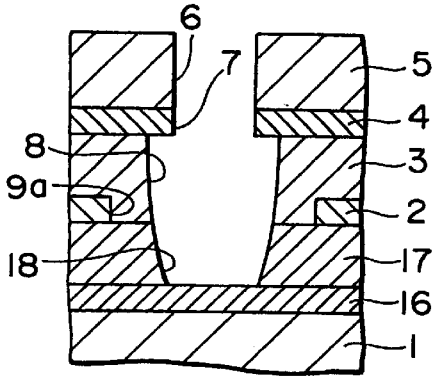

Next, as shown in FIG. 24E, the insulating layer 17 is etched by RIE or by use of hydrofluoric acid through the opening 6 of the resist film 5, the opening 7 of the gate electrode 4, the thought-hole 8 of the insulating layer 3, and the holes 9*a* and 9*b* of the cathode electrode 2, to form a hole 18 in the insulating layer 17. At this time, the insulating layer 17 is side-etched somewhat, so that as shown in FIG. 24E, the hole 18 is slightly wider than each of the holes 9*a* and 9*b* of the cathode electrode 2.

With the steps shown in FIGS. 24A to 24E, a structure equivalent to the structure in the thirteenth embodiment shown in FIG. 22 is obtained.

Figure 24F:
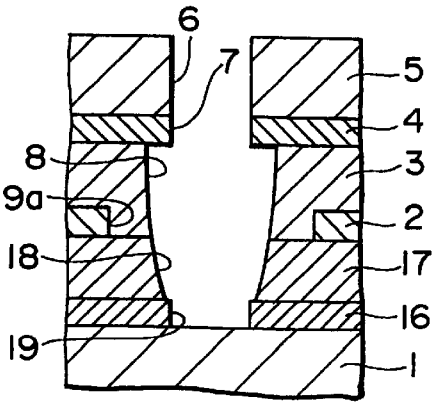

Next, as shown in FIG. 24F, the second gate electrode 16 is etched by RIE through the opening 6 of the resist film 5, the opening 7 of the gate electrode 4, the through-hole 8 of the insulating layer 3, the holes 9*a* and 9*b* of the cathode electrode 2, and the hole 18 of the insulating layer 17, to form a hole 19 in the second gate electrode 16. At this time, since the etching (RIE in this embodiment) for the second gate electrode 16 is strong in anisotropy, the hole 19 is formed into a planar shape being substantially the same as those of the opening 7 of the gate electrode 4 and the hole 9*b* of the cathode electrode 2.

The resist film 5 is then removed by ashing or the like, to obtain a structure in the fourteenth embodiment shown in FIG. 23.

Embodiment 15

Figure 25:
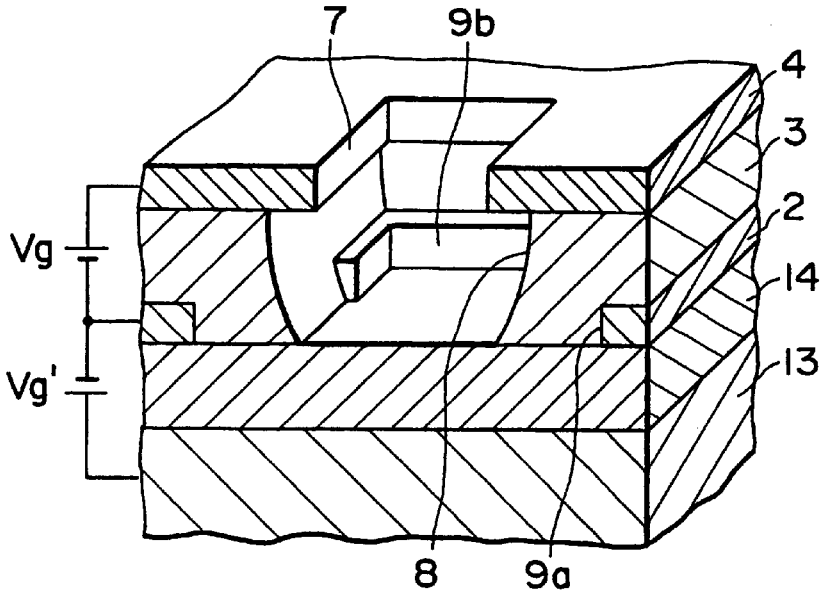
FIG. 25 is a sectional view showing a structure of a field emission element in accordance with a fifteenth embodiment of the present invention.

FIG. 25 shows a sectional structure of a field emission element in accordance with a fifteenth embodiment of the present invention. In this embodiment, parts corresponding to those in the tenth embodiment are indicated by the same characters as those in the tenth embodiment.

As shown in FIG. 25, in the fifteenth embodiment whose configuration is similar to that of the tenth embodiment shown in FIG. 19, a second gate electrode 16 which is the same as the second gate electrode 16 in the twelfth, thirteenth, and fourteenth embodiments is replaced with a conductive substrate or semiconductor substrate 13.

Accordingly, in this embodiment, the same effect as that in the twelfth embodiment can be obtained without provision of the second gate electrode.

Embodiment 16

Figure 26:
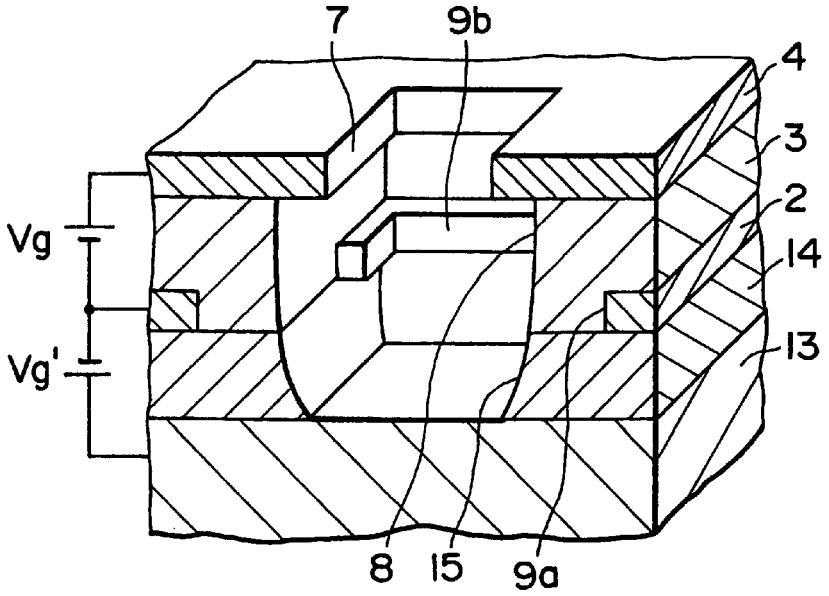
FIG. 26 is a sectional view showing a structure of a field emission element in accordance with a sixteenth embodiment of the present invention.
Figure 27A:
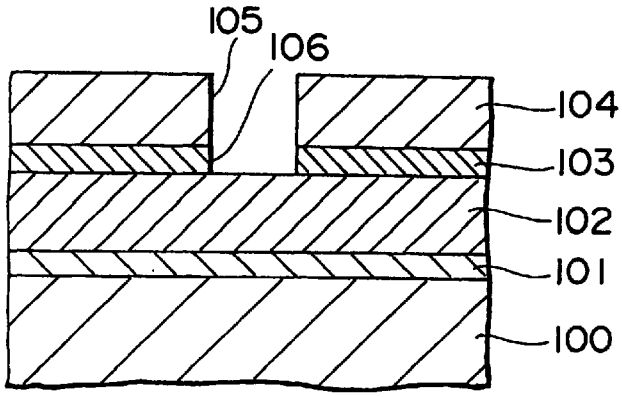
FIGS. 27A to 27C are sectional views showing sequential steps of fabricating a related art Spindt type field emission element.
Figure 27B:
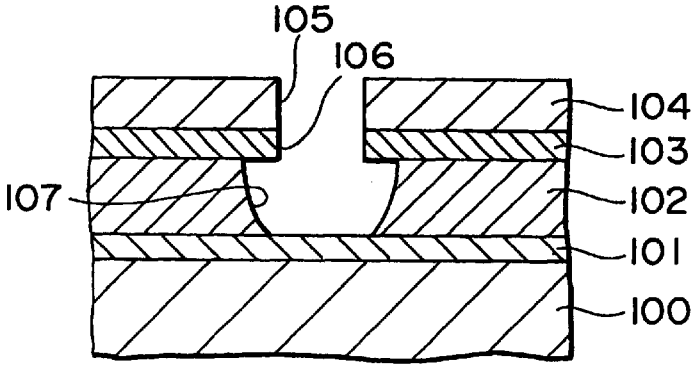
Figure 27C:
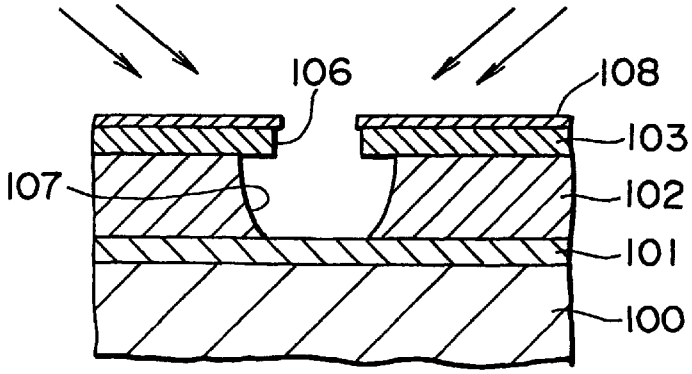
Figure 28A:
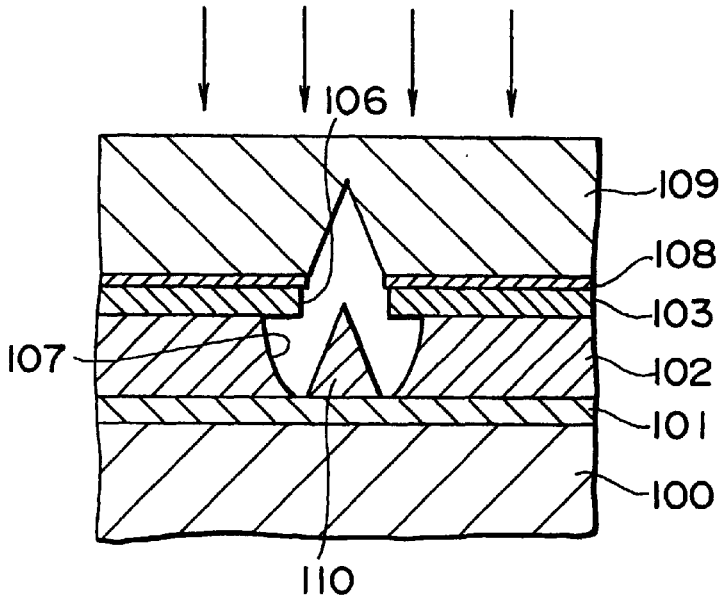
FIGS. 28A and 28B are sectional views, continuous from FIGS. 27A to 27C, showing sequential steps of fabricating the related art Spindt type field emission element.
Figure 28B:
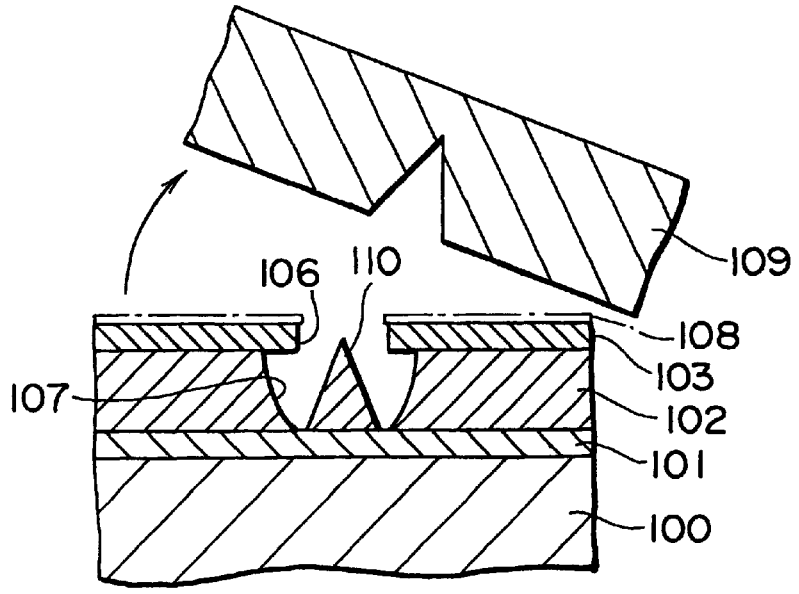

FIG. 26 shows a sectional structure of a field emission element in accordance with a sixteenth embodiment of the present invention. In this embodiment, parts corresponding to those in the eleventh embodiment are indicated by the same characters as those in the eleventh embodiment.

As shown in FIG. 26, in the sixteenth embodiment whose configuration is similar to that in the eleventh embodiment, a second gate electrode 16 which is the same as the second gate electrode 16 in the twelfth, thirteenth, and fourteenth embodiments is replaced with a conductive substrate or semiconductor substrate 13.

Accordingly, in this embodiment, the same effect as that in the thirteenth embodiment can be obtained without provision of the second gate electrode.

While the preferred embodiments of the present invention have been described, such description is for illustrative purposes only, and it is to be understood that many changes and variations may be made without departing from the spirit or scope of the following claims.

What is claimed is:

1. A method of fabricating a field emission display, comprising the steps of:

forming a first electrode layer on an insulating substrate;

forming an insulating layer o n said first electrode layer;

forming a second electrode layer on said insulating layer;

forming an opening in said second electrode layer at a specific position;

etching said insulating layer through said opening of said second electrode layer, to form in said insulating layer a through-hole continuous to said opening of said second electrode layer and wider than said opening; and anisotropic-etching the first electrode layer through said opening of said second electrode layer and said through-hole of said insulating layer, to form in said first electrode layer a hole continuous to said through-hole of said insulating layer and having a planer shape being substantially the same as that of said opening of said second electrode layer.

2. A method of fabricating a field emission display, comprising the steps of:

forming a first insulating layer on a conductive substrate or semiconductor substrate;

forming a first electrode layer on said first insulating layer;

forming a second insulating layer on said first electrode layer;

forming a second electrode layer on said second insulating layer;

forming an opening in said second electrode layer at a specific position;

etching said second insulating layer through said opening of said second electrode layer, to form in said second insulating layer a through-hole continuous to said opening of said second electrode layer and wider than said opening; and anisotropic-etching said first electrode layer through said opening of said second electrode layer and said through-hole of said second insulating layer, to form in said first electrode layer a hole continuous to said through-hole of said second insulating layer and having a planar shape being substantially the same as that of said opening of said second electrode layer.

3. A method of fabricating a field emission display according to claim 2, further comprising the step of:

forming a through-hole as said hole in said first electrode, and etching said first insulating layer through said opening of said second electrode layer, said through-hole of said second insulating layer, and said through-hole of said first electrode layer, to form in said first insulating layer a hole continuous to said through-hole of said first electrode layer.

4. A method of fabricating a field emission display, comprising the steps of:

forming a first electrode layer on an insulating substrate;

forming a first insulating layer on said first electrode layer;

forming a second electrode layer on said first insulating layer;

forming a second insulating layer on said second electrode layer;

forming a third electrode layer on said second insulating layer;

forming an opening in said third electrode layer at a specific position;

etching said second insulating layer through said opening of said third electrode layer, to form in said second insulating layer a through-hole continuous to said opening of said third electrode layer and wider than said opening; and anisotropic-etching said second electrode layer through said opening of said third electrode layer and said through-hole of said second insulating layer, to form in said second electrode layer a hole continuous to said through-hole of said second insulating layer and having a planar shape being substantially the same as that of said opening of said third electrode layer.

5. A method of fabricating a field emission display according to claim 4, further comprising the step of:

forming a through-hole as said hole in said second electrode layer, and etching said first insulating layer through said opening of said third electrode layer, said through-hole of said second insulating layer, and said through-hole of said second electrode layer, to form in said first insulating layer a hole continuous to said through-hole of said second electrode layer.

6. A method of fabricating a field emission display according to claim 5, further comprising the step of:

forming a through-hole as said hole in said first insulating layer, and etching said first electrode layer through said opening of said third electrode layer, said through-hole of said second insulating layer, said through-hole of said second electrode layer, and said through-hole of said first insulating layer, to form in said first electrode layer a hole continuous to said through-hole of said first insulating layer and having a planar shape being substantially the same as those of said opening of said third electrode layer and said through-hole of said second electrode layer.

7. A method of fabricating a field emission display, comprising the steps of:

forming a first electrode layer on an insulating substrate;

forming a first hole having a specific planar shape in said first electrode layer at a specific position;

forming an insulating layer on said first electrode layer;

forming a second electrode layer on said insulating layer;

forming, in said second electrode layer at a specific position, an opening having a planar shape being partially overlapped to said first hole of said first electrode layer;

etching said insulating layer through said opening of said second electrode layer, to form in said insulating layer a through-hole continuous to said opening of said second electrode layer and wider than said opening; and anisotropic-etching said first electrode layer through said opening of said second electrode layer and said through-hole of said insulating layer, to form in said first electrode layer a second hole continuous to said through-hole of said insulating layer and having a planar shape being substantially the same as that of said opening of said second electrode layer.

8. A method of fabricating a field emission display, comprising the steps of:

forming a first electrode layer on an insulating substrate;

forming a first insulating layer on said first electrode layer;

forming a second electrode layer on said first insulating layer;

forming, in said second electrode layer at a specific position, a first hole having a specific planar shape;

forming a second insulating layer on said second electrode layer;

forming a third electrode layer on said second insulating layer;

forming, in said third electrode at a specific position, a hole having a planar shape being partially overlapped to said first hole of said second electrode layer;

etching said second insulating layer through said opening of said third electrode layer, to form in said second insulating layer a through-hole continuous to said opening of said third electrode layer and wider than said opening; and anisotropic-etching said second electrode layer through said opening of said third electrode layer and said through-hole of said second electrode layer, to form in said second electrode layer a second hole continuous to said through-hole of said second insulating layer and having a planar shape being substantially the same as that of said opening of said third electrode layer.

9. A method of fabricating a field emission display according to claim 8, further comprising the step of:

forming a through-hole at least as said second hole in said second electrode layer, and etching said first insulating layer through said opening of said third electrode, said through-hole of said second insulating layer, and said through-hole of said second electrode layer, to form in said first insulating layer a hole continuous to said through-hole of said second electrode layer.

10. A method of fabricating a field emission display according to claim 9, further comprising the step of:

forming a through-hole as said hole in said first insulating layer, and etching said first electrode layer through said opening of said third electrode layer, said through-hole of said second insulating layer, said through-hole of said second electrode layer, and said through-hole of said first insulating layer, to form in said first electrode layer a hole continuous to said through-hole of said first insulating layer and having a planar shape being substantially the same as those of said opening of said third electrode and said through-hole of said second electrode layer.

* * * * *